US012509319B2

(12) United States Patent
Noso et al.

(10) Patent No.: US 12,509,319 B2
(45) Date of Patent: Dec. 30, 2025

(54) SHEET POST-PROCESSING DEVICE AND SHEET POST-PROCESSING SYSTEM CAPABLE OF PIVOTING FLAPPING MEMBER AND PRESSING MEMBER BY SINGLE DRIVE SOURCE

(71) Applicant: KYOCERA Document Solutions Inc., Osaka (JP)

(72) Inventors: Terumitsu Noso, Osaka (JP); Keisuke Egawa, Osaka (JP); Yasunori Ueno, Osaka (JP); Seiichi Shirasaki, Osaka (JP); Takehiko Okada, Osaka (JP); Yusuke Takano, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 253 days.

(21) Appl. No.: 18/414,393

(22) Filed: Jan. 16, 2024

(65) Prior Publication Data

US 2024/0253934 A1 Aug. 1, 2024

(30) Foreign Application Priority Data

Jan. 26, 2023 (JP) ..... 2023-010417

(51) Int. Cl.
*B65H 31/26* (2006.01)
*B65H 33/00* (2006.01)
*B65H 37/04* (2006.01)

(52) U.S. Cl.
CPC ..... *B65H 31/26* (2013.01); *B65H 33/00* (2013.01); *B65H 37/04* (2013.01);
(Continued)

(58) Field of Classification Search
CPC .. B65H 37/04; B65H 29/58; B65H 2511/212; B65H 2801/27; B65H 31/26; B65H 2301/4223
(Continued)

(56) References Cited

U.S. PATENT DOCUMENTS 7,419,150 B2 * 9/2008 Kushida ..... B65H 31/26 270/58.11
7,866,647 B2 * 1/2011 Terao ..... B65H 31/26 270/58.11
(Continued)

FOREIGN PATENT DOCUMENTS

JP 2011073805 A 4/2011
JP 2012020863 A 2/2012

*Primary Examiner* — Leslie A Nicholson, III
(74) *Attorney, Agent, or Firm* — IP Business Solutions, LLC.

(57) ABSTRACT

A sheet post-processing device includes: a loading assist mechanism including a flapping member, a pressing member, a first power transmission mechanism that pivots the flapping member from a first ready-to-pivot position, a second power transmission mechanism that pivots the pressing member from a second ready-to-pivot position, a rotary member that transmits, during rotation in a first direction, power to the first power transmission mechanism, and transmits, during rotation in a second direction, power to the second power transmission mechanism, and a drive source that rotates the rotary member; and a control device that controls the drive source to control an angle of rotation of the rotary member in the first direction, thus controlling an angle of pivoting of the flapping member, and controls the drive source to control an angle of rotation of the rotary member in the second direction, thus controlling an angle of pivoting of the pressing member.

5 Claims, 12 Drawing Sheets

(52) U.S. Cl.
CPC .... *B65H 2511/212* (2013.01); *B65H 2557/24* (2013.01); *B65H 2801/27* (2013.01)

(58) Field of Classification Search
USPC ..... 270/58.07, 58.08
See application file for complete search history.

(56) References Cited

U.S. PATENT DOCUMENTS

| | | | | |
|---|---|---|---|---|
| 8,752,819 | B2 * | 6/2014 | Sato | G03G 15/6544 270/58.12 |
| 2006/0067766 | A1 * | 3/2006 | Terao | G03G 15/6541 399/405 |
| 2011/0074081 | A1 | 3/2011 | Hirabayashi et al. | |
| 2017/0183189 | A1 * | 6/2017 | Matsuki | B65H 33/08 |

* cited by examiner

SHEET POST-PROCESSING DEVICE AND SHEET POST-PROCESSING SYSTEM CAPABLE OF PIVOTING FLAPPING MEMBER AND PRESSING MEMBER BY SINGLE DRIVE SOURCE

INCORPORATION BY REFERENCE

This application claims priority to Japanese Patent Application No. 2023-010417 filed on 26 January, 2023, the entire contents of which are incorporated by reference herein.

BACKGROUND

The present disclosure relates to sheet post-processing devices and sheet post-processing systems capable of loading a plurality of sheets on a tray and processing them thereon and particularly relates to a technique for quickly loading each of the sheets on the tray and aligning it with the other sheets.

In an image forming apparatus, an image reading device reads an image of an original document and an image forming device forms the image of the original document on a recording paper sheet (a sheet). A sheet post-processing device receives the recording paper sheet with the image of the original document formed thereon from the image forming apparatus and subjects the recording paper sheet to post-processing. An example of the post-processing performed by the sheet post-processing device is stapling processing of loading a plurality of recording paper sheets on a tray, aligning the ends of the recording paper sheets, and staples the ends of the recording paper sheets together. In the stapling processing, it is necessary to quickly load each of the recording paper sheets on the tray and keep them from misalignment.

There is generally known an image processing device in which when a sheet is conveyed down onto a tray, a flapping roller is moved down to hold the sheet between the tray and the flapping roller, the flapping roller conveys the sheet reversely, a trailing end pressing claw guides the sheet to allow the trailing end of the sheet to abut against a trailing end reference fence and thus align the sheet with the other sheets, and a stapler staples the trailing ends of the sheets together.

There is also known a sheet loading device in which when a sheet is conveyed down onto a tray, a flapping roller is moved down to hold the sheet between the tray and the flapping roller, the flapping roller conveys the sheet reversely to allow the trailing end of the sheet to abut against a trailing end reference fence and thus align the sheet with the other sheets, and a stapler staples the trailing ends of the sheets together.

SUMMARY

A technique improved over the aforementioned techniques is proposed as one aspect of the present disclosure.

A sheet post-processing device according to an aspect of the present disclosure includes a tray, a sheet discharge roller pair, a conveyance mechanism, a loading assist mechanism, a post-processing device, and a control device. The sheet discharge roller pair discharges a sheet onto the tray. The conveyance mechanism conveys the sheet on the tray in a direction opposite to a direction of sheet discharge of the sheet discharge roller pair to allow a trailing end of the sheet in the direction of sheet discharge to abut against an end of the tray. The loading assist mechanism handles the sheet on the tray. The post-processing device subjects the sheet on the tray to post-processing. The control device includes a processor, and configured to control action of the loading assist mechanism, when the processor executes a control program. The loading assist mechanism includes a flapping member, a pressing member, a first power transmission mechanism, a second power transmission mechanism, a rotary member, and a drive source. The flapping member is provided above the tray and performs a flapping action of, when the trailing end of the sheet in the direction of sheet discharge moves away from the sheet discharge roller pair and reaches above the tray, flapping the trailing end of the sheet downward to drop the sheet on the tray. The pressing member performs a pressing action of pressing the sheet dropped by the flapping member onto the tray with the trailing end of the sheet abutting against the end of the tray. The first power transmission mechanism pivots the flapping member from a predetermined first ready-to-pivot position to allow the flapping member to perform the flapping action. The second power transmission mechanism pivots the pressing member from a predetermined second ready-to-pivot position to allow the pressing member to perform the pressing action. The rotary member is rotatable in a first direction and a second direction opposite to the first direction, transmits, during rotation in the first direction, power for pivoting the flapping member to the first power transmission mechanism, and transmits, during rotation in the second direction, power for pivoting the pressing member to the second power transmission mechanism. The drive source rotates the rotary member. The control device controls the drive source to control an angle of rotation of the rotary member in the first direction and thus control an angle of pivoting of the flapping member from the first ready-to-pivot position, and controls the drive source to control an angle of rotation of the rotary member in the second direction and thus control an angle of pivoting of the pressing member from the second ready-to-pivot position.

A sheet post-processing system according to another aspect of the present disclosure includes an image forming apparatus and the above-described sheet post-processing device. The image forming apparatus includes an image forming device. The image forming device forms an image of an original document on a sheet. The sheet post-processing device further includes a conveyance roller pair. The conveyance roller pair receives the sheet with the image formed thereon from the image forming apparatus and conveys the received sheet toward the tray.

DETAILED DESCRIPTION

Figure 1:
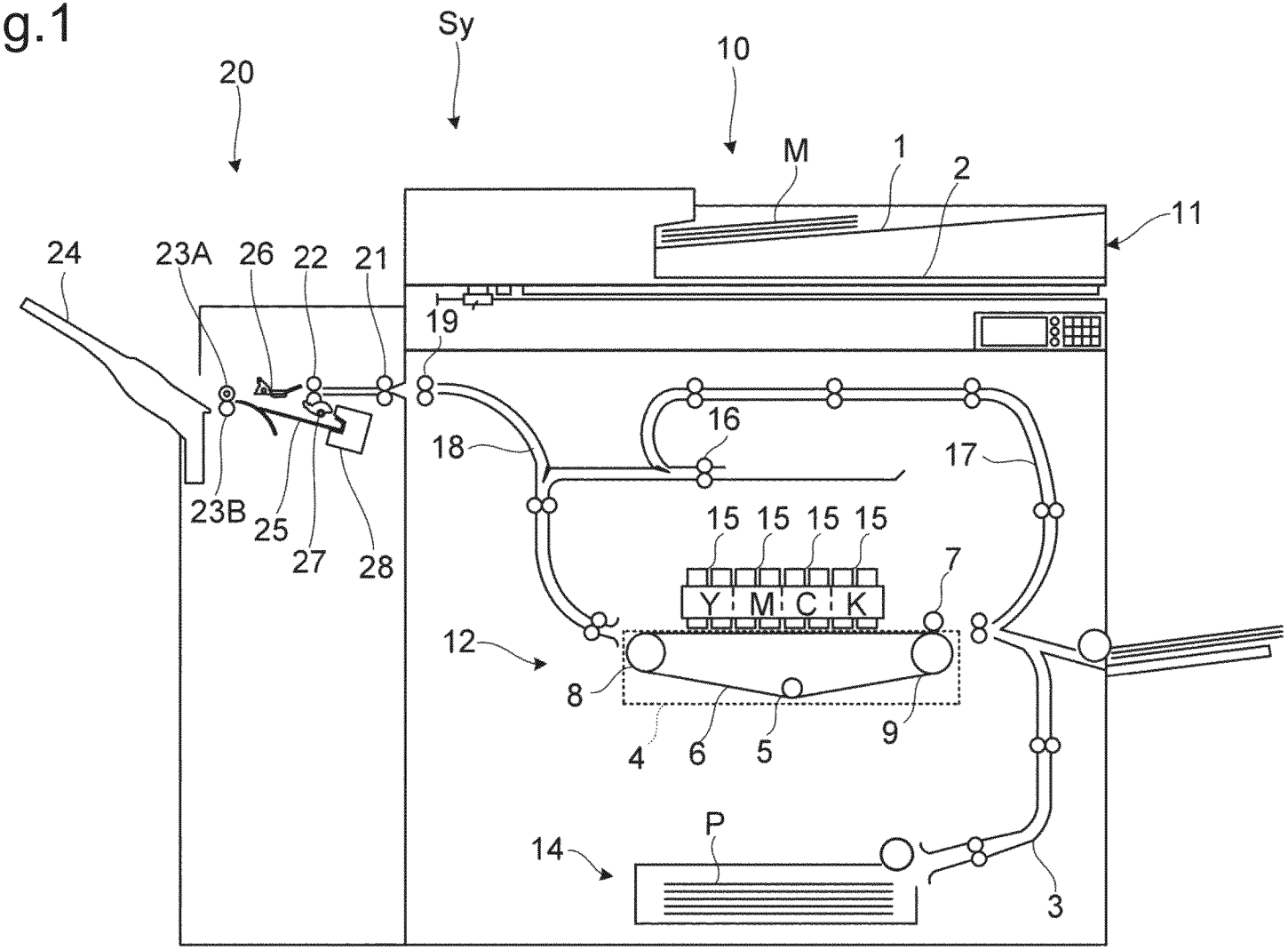
FIG. 1 is a cross-sectional view showing an image forming apparatus and a sheet post-processing device in a sheet post-processing system according to an embodiment of the present disclosure.

Hereinafter, a description will be given of one embodiment of the present disclosure with reference to the drawings. FIG. 1 is a cross-sectional view showing an image forming apparatus 10 and a sheet post-processing device 20 in a sheet post-processing system Sy according to the one embodiment of the present disclosure. The sheet post-processing system Sy includes: the image forming apparatus 10 that reads an image of an original document and forms the image on a recording paper sheet P; and the sheet post-processing device 20 that receives the recording paper sheet P from the image forming apparatus 10 and subjects the recording paper sheet P to post-processing.

The image forming apparatus 10 includes an image reading device 11 and an image forming device 12. When a plurality of original document sheets M are placed on an original document tray 1, the image reading device 11 sequentially pulls out and conveys the plurality of original document sheets M sheet by sheet from the original document tray 1, reads an image of each original document sheet M with a pickup device while conveying the original document sheet M, and sequentially ejects the read original document sheets M to an ejection tray 2 to lay them one on top of another on the ejection tray 2. The image reading device 11 converts, for the image of each original document sheet M, an analog output of the pickup device to a digital signal to generate image data representing the image of the original document sheet M.

Each time image data representing each of the images of the plurality of original document sheets M is sequentially input to the image forming device 12, the image forming device 12 forms the image of the original document sheet M represented by the image data on a recording paper sheet (a sheet) P using an ink-jet system. The image forming device 12 includes respective line heads (examples of ink heads) 15 that discharge ink drops of four colors (black, cyan, magenta, and yellow). The line heads 15 discharge ink drops of the individual colors onto the recording paper sheet P being conveyed from a sheet feed device 14 via a first conveyance path 3 to a conveyance unit 4, thus forming a multicolor image on the recording paper sheet P.

The conveyance unit 4 includes a drive roller 8, a driven roller 9, a tension roller 5, and a conveying belt 6. The conveying belt 6 is an endless belt and is mounted around the drive roller 8, the driven roller 9, and the tension roller 5. The drive roller 8 is driven into counterclockwise rotation by a motor. When the drive roller 8 is driven into rotation, the conveying belt 6 travels around the above rollers counterclockwise and the driven roller 9 and the tension roller 5 rotate counterclockwise by following the travel of the conveying belt 6 engaged on them.

The tension roller 5 appropriately holds the tension of the conveying belt 6. An adsorption roller 7 is in contact with the conveying belt 6. The adsorption roller 7 electrically charges the conveying belt 6 to electrostatically adsorb on the conveying belt 6 a recording paper sheet P being fed from the sheet feed device 14.

When the image forming device 12 forms the image of each original document sheet M on a recording paper sheet P, the image forming apparatus 10 allows the recording paper sheet P to be conveyed via an intermediate conveyance path 18 to the sheet post-processing device 20 by a conveyance roller 19.

In further recording an image of the original document sheet M on the back side of the recording paper sheet P, the image forming apparatus 10 performs switchback conveyance of the recording paper sheet P, in which the recording paper sheet P is conveyed from the intermediate conveyance path 18 to a conveyance roller 16 and the conveyance roller 16 is stopped and then reversely rotated. After the switchback conveyance, the image forming apparatus 10 returns the recording paper sheet P via a second conveyance path 17 to the conveyance unit 4, thus turning over the recording paper sheet P. When the image forming device 12 forms the image of the original document sheet M on the back side of the recording paper sheet P, the image forming apparatus 10 allows the recording paper sheet P to be conveyed via the intermediate conveyance path 18 to the sheet post-processing device 20 by the conveyance roller 19.

Figure 2:
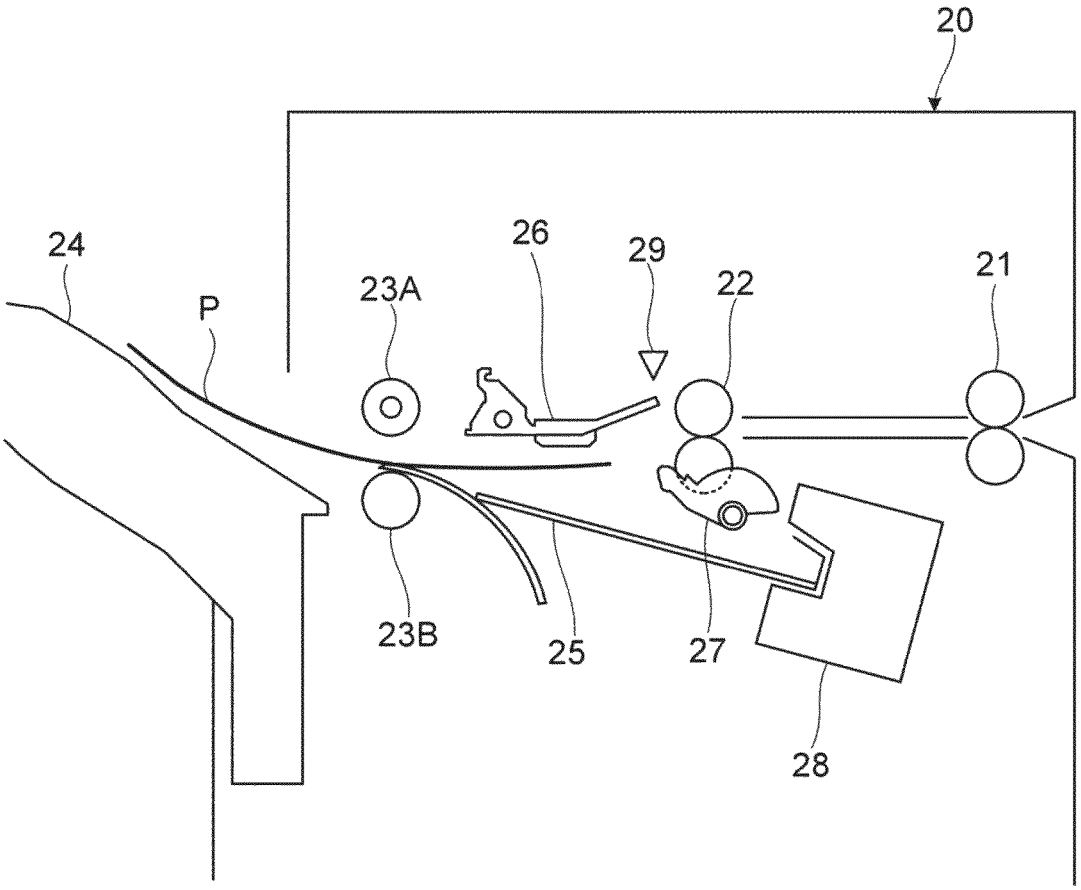
FIG. 2 is a cross-sectional view showing the sheet post-processing device in magnification.

FIG. 2 is a cross-sectional view showing the sheet post-processing device 20 in magnification. As shown in FIG. 2, the sheet post-processing device 20 includes a conveyance roller pair 21, an intermediate sheet discharge roller pair 22 (an example of a sheet discharge roller pair), a pair of opposed upper and lower ejection rollers 23A, 23B located above and below each other, an ejection tray 24, a processing tray 25, a flapping member 26, a pressing member 27, a stapling device 28 (an example of a post-processing device), a sheet discharge sensor 29, and so on. The flapping member 26 and the pressing member 27 are provided as elements of a loading assist mechanism 500.

In the sheet post-processing device 20, the conveyance roller pair 21 and the intermediate sheet discharge roller pair 22 convey a recording paper sheet P being conveyed from the image forming apparatus 10 to allow it to pass under the flapping member 26, and eject the recording paper sheet P through the pair of upper and lower ejection rollers 23A, 23B to the ejection tray 24 or allow the recording paper sheet P to be received by the processing tray 25. The stapling device 28 staples together the ends of the plurality of recording paper sheets P loaded on the processing tray 25. The sheet post-processing device 20 ejects the stapled set of recording paper sheets P from the processing tray 25 to the ejection tray 24 by the rotation and nip of the pair of upper and lower ejection rollers 23A, 23B.

A transferring mechanism capable of moving up and down the upper ejection roller 23 A is provided in the sheet post-processing device 20. The transferring mechanism moves the upper ejection roller 23A in the up-and-down direction to press the upper ejection roller 23A against the lower ejection roller 23B or move the upper ejection roller 23A away from the lower ejection roller 23B. While the upper ejection roller 23A is kept away from the lower ejection roller 23B, the trailing end of the recording paper sheet P (its trailing end in the direction of sheet conveyance, hereinafter, referred to simply as its "trailing end") passes through the intermediate sheet discharge roller pair 22, the leading end of the recording paper sheet P (its leading end in the direction of sheet conveyance, hereinafter, referred to simply as its "leading end") reaches between the pair of upper and lower ejection rollers 23A, 23B and is inserted between them, and the trailing end of the recording paper sheet P moves above the processing tray 25.

The sheet discharge sensor 29 detects the trailing end of the recording paper sheet P having passed through the intermediate sheet discharge roller pair 22. With the timing of the sheet discharge sensor 29 detecting the trailing end of the recording paper sheet P, the flapping member 26 pivots clockwise in FIG. 2 together with a shaft 26A (see FIGS. 4A and 4B) about the axis of the shaft 26A from an original position shown in FIG. 2 and, thus, the trailing end of the recording paper sheet P is pushed down onto the processing tray 25 by the flapping member 26. The flapping member 26 is provided above the processing tray 25. At the time when the trailing end of the recording paper sheet P being discharged toward the processing tray 25 by the intermediate sheet discharge roller pair 22 moves away from the intermediate sheet discharge roller pair 22 and reaches above the processing tray 25, the flapping member 26 flaps down the trailing end of the recording paper sheet P to drop it on the processing tray 25.

Subsequently, the control device 46 (see FIG. 3) of the image forming apparatus 10 controls the transferring mechanism to move the upper ejection roller 23A toward the lower ejection roller 23B and allow the upper ejection roller 23A to press the lower ejection roller 23B. Thus, the leading end of the recording paper sheet P is held between the pair of ejection rollers 23A, 23B. The control device 46 rotates the ejection rollers 23A, 23B in opposite directions to those during sheet ejection to the ejection tray 24 and, thus, the recording paper sheet P is moved on the processing tray 25 toward the stapling device 28 by the ejection rollers 23A, 23B. As a result, the trailing end of the recording paper sheet P abuts against a reference surface 28A (see FIGS. 4A and 4B) of the stapling device 28. In this embodiment, the pair of ejection rollers 23A, 23B is an example of the conveyance mechanism.

The present disclosure is not limited to the structure in which the pair of ejection rollers 23A, 23B operates as the conveyance mechanism. For example, the conveyance mechanism may be a separately provided paddling mechanism that comes into contact with the recording paper sheet P on the processing tray 25 while rotating, thus conveying the recording paper sheet P in the opposite direction to the direction of sheet ejection.

During the movement of the recording paper sheet P toward the stapling device 28, the flapping member 26 occupies a position a distance from a loading surface of the processing tray 25 where the recording paper sheet P is to be loaded. During the above movement of the recording paper sheet P, the trailing end of the recording paper sheet P passes through the above distance. When the trailing end of the recording paper sheet P is curled, the curled trailing end of the recording paper sheet P is held down by the flapping member 26. Thus, the trailing end of the recording paper sheet P is quickly tucked into a sheet receiving portion 280 defined by the reference surface 28A and a top side portion 28B (see FIGS. 4A and 4B) of the stapling device 28. Thus, the trailing end of the recording paper sheet P quickly abuts against the reference surface 28A of the stapling device 28.

The flapping member 26 is pivoted counterclockwise in FIG. 2 together with the shaft 26A about the axis of the shaft 26A by a drive force supplied from a drive motor 52 (see FIG. 3), thus returning to the original position shown in FIG. 2.

With the timing of the trailing end of the recording paper sheet P abutting against the reference surface 28A of the stapling device 28, the pressing member 27 is pivoted counterclockwise in FIG. 2 together with a shaft 27A (see FIGS. 4A and 4B) about the axis of the shaft 27A by a drive force supplied from the drive motor 52, thus pressing the recording paper sheet P onto the processing tray 25 from above.

Subsequently, the upper ejection roller 23A moves away from the lower ejection roller 23B. A next recording paper sheet P is conveyed by the conveyance roller pair 21 and the intermediate sheet discharge roller pair 22 and passes under the flapping member 26 and, thus, the leading end of the next recording paper sheet P reaches and enters between the pair of upper and lower ejection rollers 23A, 23B.

When the trailing end of the next recording paper sheet P moves above the processing tray 25 and the sheet discharge sensor 29 detects the trailing end of the next recording paper sheet P, the upper ejection roller 23 moves toward the lower ejection roller 23B and presses the lower ejection roller 23B. The pressing member 27 pivots clockwise in FIG. 2 together with the shaft 27A about the axis of the shaft 27A to return to an original position.

In doing so, in the same manner as described previously, the flapping member 26 pushes down the trailing end of the recording paper sheet P onto the processing tray 25, the recording paper sheet P is moved on the processing tray 25 toward the stapling device 28 by the rotation and nip of the pair of ejection rollers 23A, 23B, and the trailing end of the recording paper sheet P thus abuts against the reference surface 28A of the stapling device 28. The pressing member 27 presses the recording paper sheet P in this state onto the processing tray 25. Thereafter, the same operation is repeated each time a new recording paper sheet P is conveyed to the processing tray 25.

When the conveyance of all of a scheduled number of recording paper sheets P to the processing tray 25 is completed and the plurality of recording paper sheets P are stacked on the processing tray 25, the stapling device 28 staples the trailing ends of the plurality of recording paper sheets P together. A recording paper sheet bundle conveyance roller conveys the bundle of the stapled recording paper sheets P toward the pair of ejection rollers 23A, 23B. At this point of time, the leading end of the bundle of recording paper sheets P is still on the way to moving to the location of the pair of ejection rollers 23A, 23B. In this state, the upper ejection roller 23A moves toward the lower ejection roller 23B and presses the lower ejection roller 23B and, thus, the leading end of the bundle of recording paper sheets P is held between the pair of ejection rollers 23A, 23B. Both the ejection rollers 23A, 23B rotate in their forward directions (the directions to eject the bundle of recording paper sheets P to the ejection tray 24) and, thus, the bundle of recording paper sheets P is ejected from the processing tray 25 to the ejection tray 24 by the pair of ejection rollers 23A, 23B.

Figure 3:
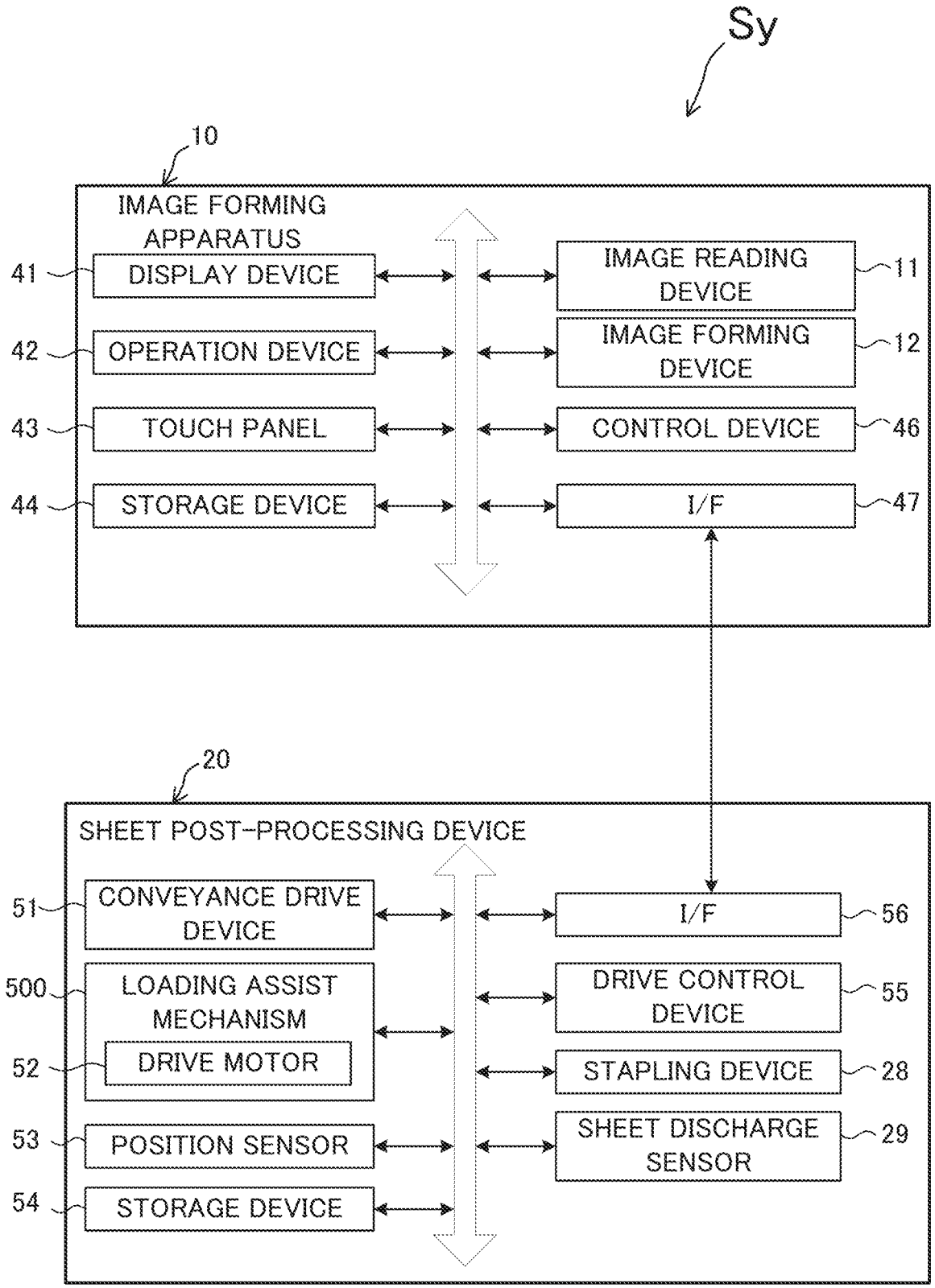
FIG. 3 is a functional block diagram showing essential internal configurations of the image forming apparatus and the sheet post-processing device.

As will be described later, the sheet post-processing device 20 according to this embodiment adopts a structure in which the flapping member 26 and the pressing member 27 are pivoted by drive forces supplied from a single drive motor 52 (see FIG. 3). Thus, increases in size, complexity, and cost of the device can be avoided.

Next, a description will be given of configurations related to the control of the image forming apparatus 10 and the sheet post-processing device 20. FIG. 3 is a functional block diagram showing essential internal configurations of the image forming apparatus 10 and the sheet post-processing device 20. As shown in FIG. 3, the image forming apparatus 10 includes the image reading device 11, the image forming device 12, a display device 41, an operation device 42, a touch panel 43, a storage device 44, the control device 46, and an interface 47. These components can transmit and receive data or signals to and from each other via a bus.

The display device 41 is formed of a liquid crystal display (LCD), an organic EL display (organic light-emitting diode (OLED) display) or the like.

The operation device 42 includes physical keys, including numeric keys, an Enter key, and a Start key. The operation device 42 accepts the input of various operation instructions associated with user's operations on the numeric keys or other keys.

The touch panel 43 is disposed over the screen of the display device 41. The touch panel 43 is a touch panel of a resistive film system, a capacitance system or any other system. The touch panel 43 detects a touch on the touch panel 43 with a user's finger or the like, together with a point of the touch, and outputs a detection signal indicating the coordinate of the point of touch to the control device 46.

The storage device 44 is a large storage device, such as an SSD (solid state drive) or an HDD (hard disk drive). The storage device 44 holds various types of application programs and various types of data.

The control device 46 is made up of a processor, a RAM (random access memory), a ROM (read only memory), and so on. The processor is, for example, a CPU (central processing unit), an ASIC (application specific integrated circuit) or an MPU (micro processing unit). The processor executes a control program stored in the above ROM or the storage device 44 to function as a processor that executes various types of processing necessary for image formation by the image forming apparatus 10.

The control device 46 is connected to the image reading device 11, the image forming device 12, the display device 41, the operation device 42, the touch panel 43, the storage device 44, the interface 47, and so on. The control device 46 performs operation control on each of the above components and signal or data transfer to and from each of the components. The control device 46 also controls the action of a loading assist mechanism 500.

The control device 46 controls the display operation of the display device 41. The control device 46 accepts an operation instruction input based on a detection signal output from the touch panel 43 or a user's operation on the numeric keys or other physical keys of the operation device 42. For example, the control device 46 accepts through the touch panel 43 a user's touch gesture on a GUI (graphical user interface) or the like being displayed on the screen of the display device 41.

The sheet post-processing device 20 includes the stapling device 28, the sheet discharge sensor 29, a conveyance drive device 51, the drive motor 52, a position sensor 53, a storage device 54, a drive control device 55, and an interface 56. These components can transmit and receive data or signals to and from each other via a bus.

The sheet discharge sensor 29 detects the trailing end of a recording paper sheet P having passed between the intermediate sheet discharge roller pair 22. The sheet discharge sensor 29 is, for example, an optical reflective sensor including: a light-emitting element that emits light to a recording paper sheet P; and a light-receiving element that receives light reflected on the recording paper sheet P.

The conveyance drive device 51 includes a motor, an actuator, a clutch, and so on for use in rotating the conveyance roller pair 21, the intermediate sheet discharge roller pair 22, and the upper and lower ejection rollers 23A, 23B and moving up and down the upper ejection roller 23A. The conveyance drive device 51 ejects a recording paper sheet P conveyed from the image forming apparatus 10 directly to the ejection tray 24 or allows a plurality of recording paper sheets P to be first loaded on the processing tray 25 and then ejects the plurality of recording paper sheets P loaded on the processing tray 25 from the processing tray 25 to the ejection tray 24.

The drive motor 52 is a motor that pivots the flapping member 26 and the pressing member 27. An example of the drive motor 52 that can be applied is a stepping motor.

The position sensor 53 detects the pivotal positions (attitudes) of the flapping member 26 and the pressing member 27. The position sensor 53 is, for example, a transmissive photosensor (photo-interrupter).

The drive control device 55 is formed of a processor, a RAM, a ROM, and so on.

The control device 46 of the image forming apparatus 10 and the drive control device 55 of the sheet post-processing device 20 input and output data or signals to and from each other through their respective interfaces 47 and 56. For example, the control device 46 of the image forming apparatus 10 outputs a control signal for post-processing of the sheet post-processing device 20 to the drive control device 55 of the sheet post-processing device 20. The drive control device 55 of the sheet post-processing device 20 controls, according to the control signal, the drives of the stapling device 28, the conveyance drive device 51, and the drive motor 52.

In allowing the sheet post-processing system Sy to execute stapling processing, the user first inputs an instruction for settings of the stapling processing to the touch panel 43 by a gesture on the GUI being displayed on the screen of the display device 41 and the control device 46 accepts the instruction for settings. Subsequently, the user places a plurality of original document sheets M in the image reading device 11. The user inputs an instruction to execute reading of original document sheets, image formation, and stapling processing by an operation on the Start key of the operation device 42 and the control device 46 accepts the instruction to execute them.

The control device 46 outputs a control signal indicating stapling processing through the interface 47 to the sheet post-processing device 20 and allows the image reading device 11 to sequentially read images of the plurality of original document sheets M. The control device 46 allows the image forming device 12 to form the images of the original document sheets M on respective recording paper sheets P. The control device 46 allows the conveyance roller 19 to sequentially convey the recording paper sheets P with images formed thereon to the sheet post-processing device 20.

When the control signal indicating stapling processing is input through the interface 56 to the drive control device 55 of the sheet post-processing device 20, the drive control device 55 controls, based on the control signal, the drives of the stapling device 28, the conveyance drive device 51, and the drive motor 52 to allow the sheet post-processing device 20 to sequentially receive the recording paper sheets P conveyed from the image forming apparatus 10 and load the recording paper sheets P on the processing tray 25. Then, the drive control device 55 allows the ends of the plurality of recording paper sheets P to be stapled together and allows the stapled bundle of recording paper sheets P to be ejected from the processing tray 25 to the ejection tray 24.

Next, a description will be given in detail of a drive mechanism and actions of the flapping member 26 and the pressing member 27 when each of recording paper sheets P is conveyed to the processing tray 25 in the sheet post-processing device 20.

<Drive Mechanism of Flapping Member 26 and Pressing Member 27>

Figure 4A:
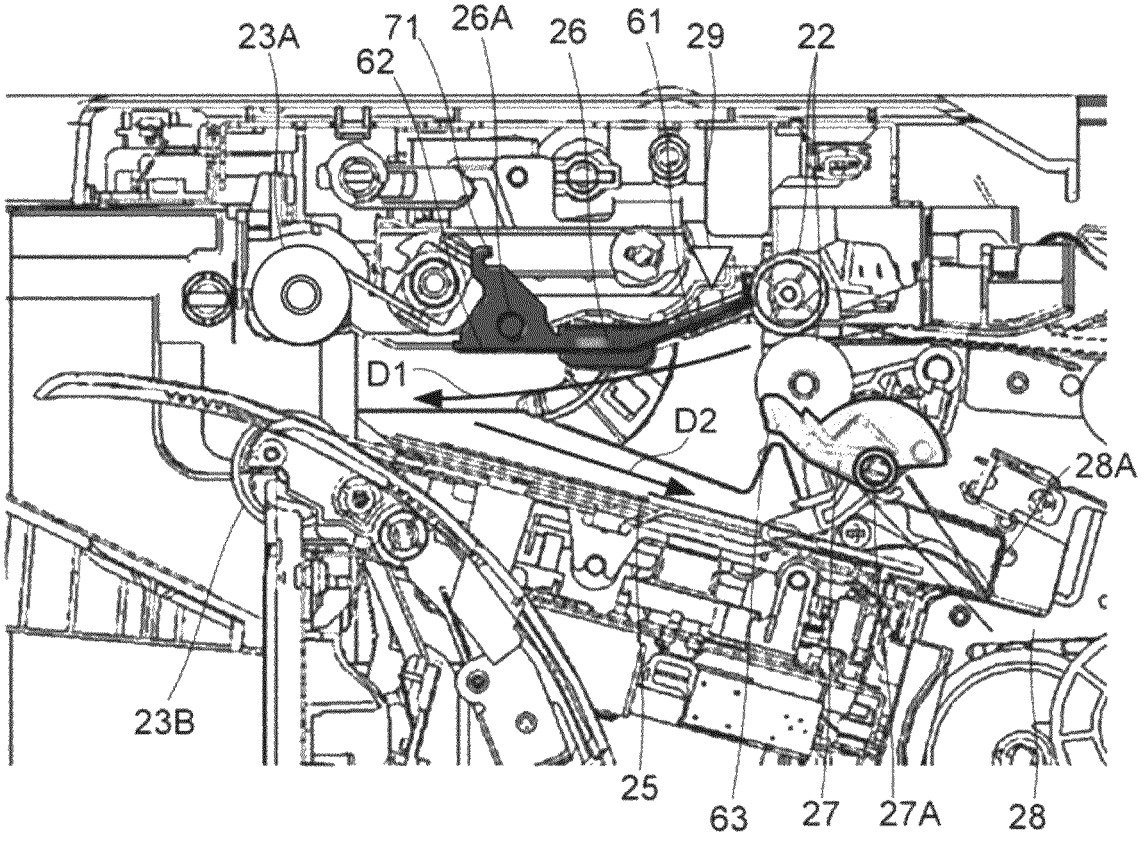
FIG. 4A is a cross-sectional view showing structures of and around a flapping member and a pressing member in the sheet post-processing device.
Figure 4B:
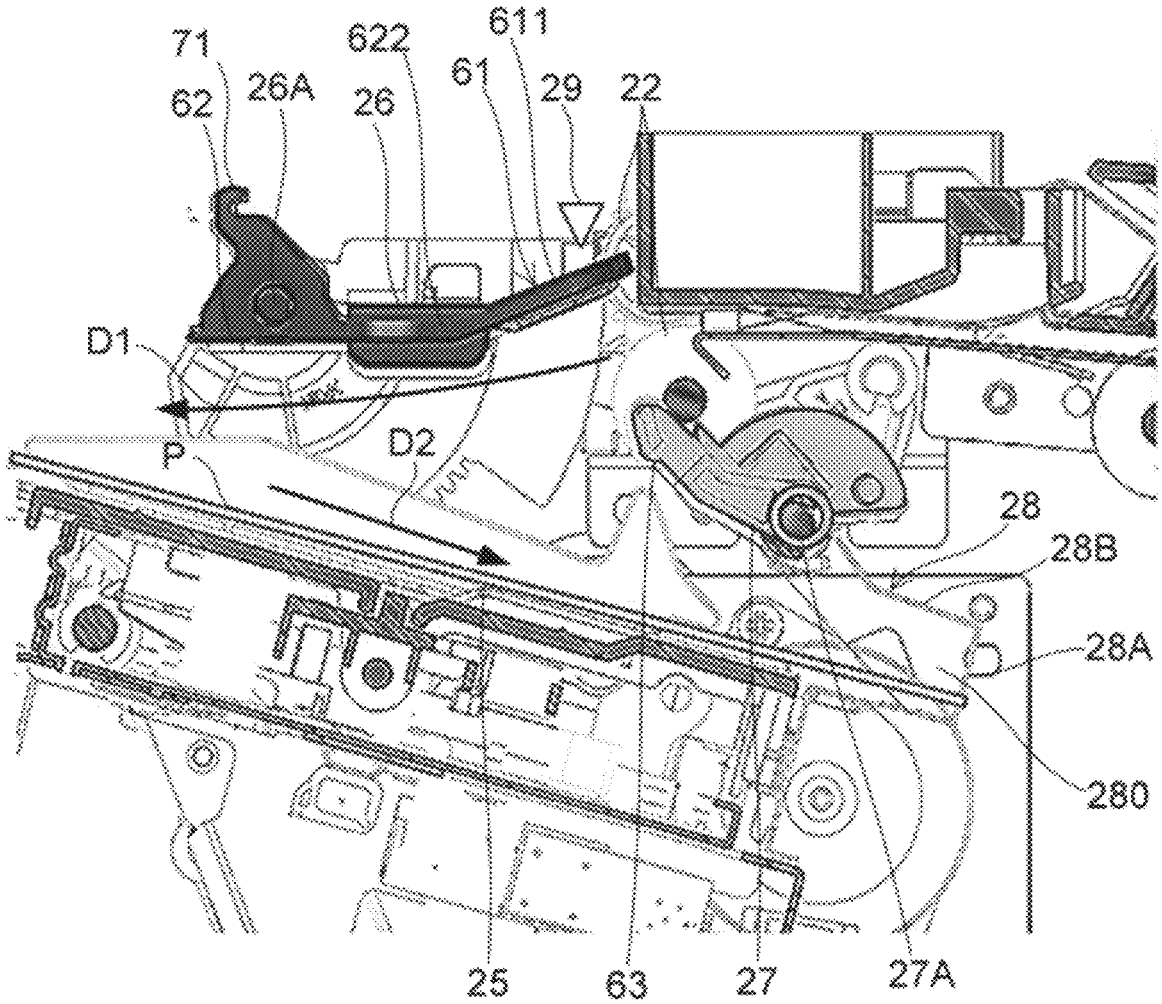
FIG. 4B is a cross-sectional view showing the structures of and around the flapping member and the pressing member in magnification.
Figure 5A:
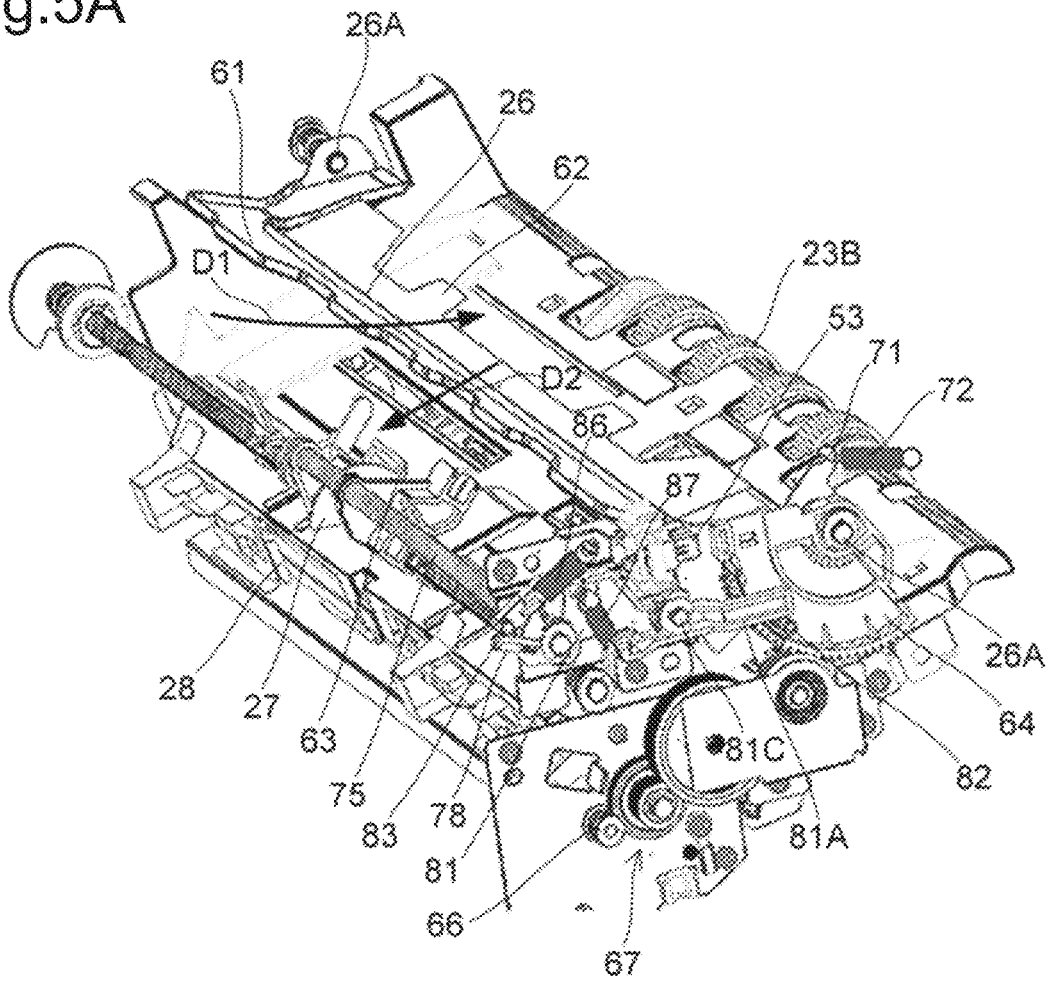
FIG. 5A is a perspective view showing the structures of and around the flapping member and the pressing member when viewed from obliquely above.
Figure 5B:
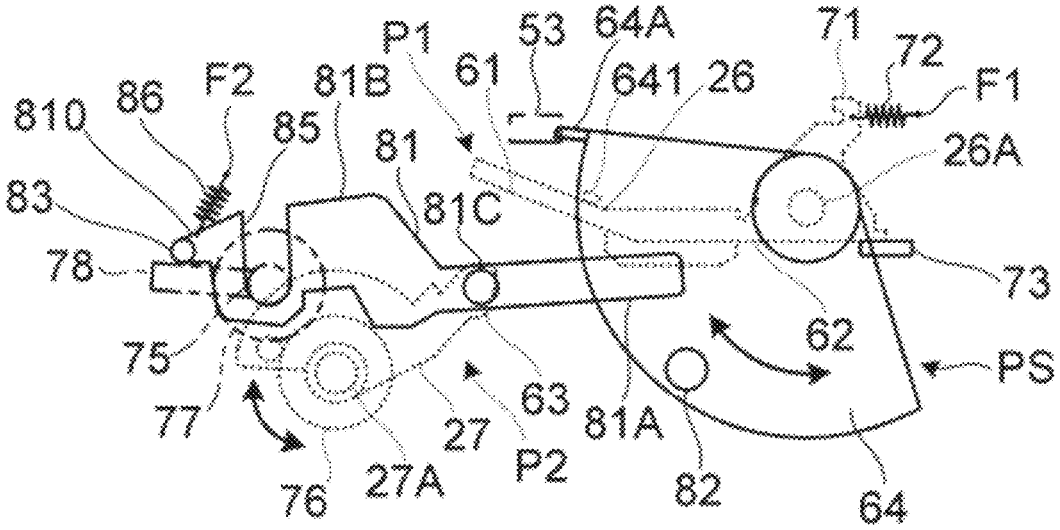
FIG. 5B is a side view schematically showing a mechanism for pivoting the flapping member and the pressing member.

FIG. 4A is a cross-sectional view showing structures of and around the flapping member 26 and the pressing member 27 in the sheet post-processing device 20. FIG. 4B is a cross-sectional view showing the structures of and around the flapping member 26 and the pressing member 27 in magnification. FIG. 4B shows a state where the flapping member 26 and the pressing member 27 are each in a ready-to-pivot position. FIG. 5A is a perspective view showing the structures of and around the flapping member 26 and the pressing member 27 when viewed from obliquely above. FIG. 5B is a side view schematically showing a mechanism for pivoting the flapping member 26 and the pressing member 27. FIG. 5B shows a state where the flapping member 26 and the pressing member 27 are each in a ready-to-pivot position.

FIGS. 4A and 4B are views showing the sheet post-processing device 20 when viewed from the front side thereof. FIGS. 5A and 5B are views showing the sheet post-processing device 20 when viewed from the back side thereof. Therefore, the direction D1 indicating the direction of conveyance of a recording paper sheet P by the intermediate sheet discharge roller pair 22 in FIGS. 4A and 4B is opposite to that in FIGS. 5A and 5B, and the direction D2 indicating the direction of conveyance of the recording paper sheet P to the stapling device 28 by the pair of ejection rollers 23A, 23B in FIGS. 4A and 4B is opposite to that in FIGS. 5A and 5B.

In order to make more visible the structures of and around the flapping member 26 and the pressing member 27, the conveyance roller pair 21, the intermediate sheet discharge roller pair 22, and the upper ejection roller 23A are omitted from FIGS. 5A and 5B.

As shown in FIG. 4B, the flapping member 26 includes a flapping portion 61 and a guide portion 62. The flapping member 26 extends in a widthwise direction of a recording paper sheet P and is pivotably supported by the shaft 26A having an axis of pivoting of the flapping member 26. The flapping member 26 is provided above the processing tray 25 and between the intermediate sheet discharge roller pair 22 and the pair of ejection rollers 23A, 23B. The flapping member 26 is disposed above a conveyance path for a recording paper sheet P leading from the intermediate sheet discharge roller pair 22 to the pair of ejection rollers 23A, 23B. The flapping portion 61 extends upstream from the guide portion 62 in the direction of conveyance of the recording paper sheet P to the vicinity of the intermediate sheet discharge roller pair 22. The flapping portion 61 includes a distal end portion 611 located on an upstream side in the direction of sheet conveyance and a base end portion 622 connected to the guide portion 62. The flapping member 26 has a shape in which the distal end portion 611 bends obliquely from the base end portion 622 so that an upstream end of the distal end portion 611 in the direction of sheet conveyance is directed away from the processing tray 25.

As shown in FIGS. 4A, 4B, and 5A, the pressing member 27 is supported pivotably by the shaft 27A passing through it in the widthwise direction of the recording paper sheet P with the axis of the shaft 27A as the axis of pivoting. The pressing member 27 includes a pressing end portion 63 extending downstream in the direction of sheet conveyance (toward the ejection tray 24). The pressing member 27 is disposed in a location corresponding to the widthwise center of the recording paper sheet P. The pressing member 27 is disposed in a location above the processing tray 25 and closer to the sheet receiving portion 280 and the stapling device 28 than the flapping member 26 when viewed from laterally of both the members 26 and 27.

As shown in FIGS. 5A and 5B, a coil spring 72 serving as a tension spring is spanned between an upper end 71 of the flapping member 26 and a stationary position F1 on a frame of the sheet post-processing device 20. The flapping member 26 is urged into clockwise pivoting in FIG. 5B together with the shaft 26A about the axis of the shaft 26A by the coil spring 72. As a result, a portion of the guide portion 62 of the flapping member 26 abuts against a stopper 73 and, thus, the flapping member 26 is positioned in a first ready-to-pivot position P1.

The sheet post-processing device 20 further includes a sector gear 64. A projection 641 projecting toward the flapping member 26 is provided on a flat side surface of the sector gear 64.

When rotation of a gear 66 (see FIG. 5A) fixed to an output shaft of the drive motor 52 (see FIG. 3) is transmitted via a gear unit 67 to the sector gear 64, the sector gear 64 rotates. When the direction of rotation of the drive motor 52 changes, the direction of rotation of the sector gear 64 also changes. The drive motor 52 is, for example, a stepping motor. According to the number of revolutions of the drive motor 52, the angle of rotation of the sector gear 64 changes.

The drive control device 55 (see FIG. 3) controls the drive of the drive motor 52 and controls the direction of rotation and the number of revolutions of the drive motor 52 to control the direction of rotation and the angle of rotation of the sector gear 64.

As shown in FIGS. 5A and 5B, the position sensor 53 detects an end 64A of the sector gear 64 positioned in an initial rotational position PS. Specifically, the position sensor 53 detects that, due to entry of the end 64A into a slot in the position sensor 53, the optical path between the light-emitting element and the light-receiving element is interrupted and the light-receiving element is thus kept from receiving light from the light-emitting element, based on which the position sensor 53 detects that the end 64A of the sector gear 64 is located in the initial rotational position PS.

When the sector gear 64 is located in the initial rotational position PS, a portion of the guide portion 62 of the flapping member 26 abuts against the stopper 73 and, thus, the flapping member 26 is positioned in the first ready-to-pivot position P1.

When the sector gear 64 rotates counterclockwise in FIG. 5B from the initial rotational position PS, the projection 641 provided on the sector gear 64 angularly moves with the rotation of the sector gear 64. As a result, the projection 641 engages the distal end portion 611 of the flapping member 26 and pushes the flapping member 26 counterclockwise. By this pushing, the shaft 26A and the flapping member 26 pivot counterclockwise against the urging force of the coil spring 72.

On the other hand, when the sector gear 64 rotates clockwise in FIG. 5B from the initial rotational position PS, i.e., from the position shown in FIG. 5B, the projection 641 does not engage the distal end portion 611 of the flapping member 26 and therefore does not push the flapping member 26. As a result, the guide portion 62 of the flapping member 26 is held in abutment against the stopper 73 and, thus, the flapping member 26 remains positioned in the first ready-to-pivot position P1.

When the sector gear 64 rotates counterclockwise in FIG. 5B from the initial rotational position PS, the flapping member 26 is thus pivoted counterclockwise by the projection 641 of the sector gear 64, and the sector gear 64 subsequently rotates clockwise, the flapping member 26 is released from engagement with and pushing of the projection 641. As a result, the flapping member 26 is pivoted clockwise in FIG. 5B by the urging force of the coil spring 72 until the guide portion 62 of the flapping member 26 abuts against the stopper 73 and, thus, the flapping member 26 returns to the first ready-to-pivot position P1.

Under a situation where the position sensor 53 is detecting the end 64A of the sector gear 64, the drive control device 55 (see FIG. 3) rotates the drive motor 52 in a certain direction (hereinafter, referred to as a forward direction) to rotate the sector gear 64 counterclockwise in FIG. 5B from the initial rotational position PS. After, thus, the flapping member 26 is pivoted counterclockwise, the drive control device 55 rotates the drive motor 52 in the reverse direction opposite to the forward direction to rotate the sector gear 64 clockwise in FIG. 5B. Thus, the flapping member 26 is pivoted clockwise by the urging force of the coil sprint 72. With the timing of the position sensor 53 detecting the end 64A of the sector gear 64, the drive control device 55 stops the drive motor 52. At this time, the sector gear 64 is rotated by the urging force of the coil spring 72 to return to the initial rotational position PS. The guide portion 62 of the flapping member 26 abuts against the stopper 73 and, thus, the flapping member 26 returns to the first ready-to-pivot position P1.

Under a situation where the position sensor 53 is detecting the end 64A of the sector gear 64, the drive control device 55 rotates the drive motor 52 in the reverse direction described above to rotate the sector gear 64 clockwise in FIG. 5B from the initial rotational position PS. Subsequently, the drive control device 55 rotates the drive motor 52 in the forward direction to rotate the sector gear 64 counterclockwise. With the timing of the position sensor 53 detecting the end 64A of the sector gear 64, the drive control device 55 stops the drive motor 52. Thus, the sector gear 64 returns to the initial rotational position PS.

As shown in FIGS. 5A and 5B, a transmission shaft 75 is provided along the widthwise direction of the recording paper sheet P and in parallel with the shaft 27A of the pressing member 27. A gear 76 is fixed to the shaft 27A of the pressing member 27 to allow the gear 76 to rotate simultaneously with the shaft 27A. A gear 77 is fixed to the transmission shaft 75 to allow the gear 77 to rotate simultaneously with the transmission shaft 75. Both the gears 76 and 77 mesh with each other. A lever 78 is fixed to an end of the transmission shaft 75 in a lengthwise direction thereof. When the transmission shaft 75 rotates clockwise in FIG. 5B, the rotation of the transmission shaft 75 transmits via the gears 77 and 76 to the shaft 27A and, thus, the pressing member 27 pivots counterclockwise in FIG. 5B. When the transmission shaft 75 rotates counterclockwise in FIG. 5B, the rotation of the transmission shaft 75 transmits via the gears 77 and 76 to the shaft 27A and, thus, the pressing member 27 pivots clockwise in FIG. 5B.

An arm 81 is provided to operatively connect a pin 82 provided on and projecting from a side surface of the sector gear 64 to the lever 78 on the transmission shaft 75. The arm 81 is pivotably supported by and about a shaft 81C. An end portion 81A of the arm 81 extends to the side surface of the sector gear 64. When the sector gear 64 rotates clockwise in FIG. 5B, the pin 82 of the sector gear 64 abuts against the arm 81 and pushes up the arm 81 and, thus, the arm 81 pivots counterclockwise about the shaft 81C.

A pin 83 is provided at an end 810 of another end portion 81B of the arm 81. A recess 85 is formed in the other end portion 81B of the arm 81. The transmission shaft 75 is engaged in the recess 85.

The other end portion 81B of the arm 81 is attached to a stationary position F2 on the frame of the sheet post-processing device 20 by a coil spring 86 serving as a tension spring. When the arm 81 is pivoted clockwise in FIG. 5B about the shaft 81C by the urging of the coil spring 86, a bottom edge of the recess 85 in the arm 81 abuts against the transmission shaft 75 and, thus, the arm 81 is positioned in this position.

The transmission shaft 75 is urged into rotation clockwise in FIG. 5A by a coil spring 87 (see FIG. 5A) serving as a tension spring. A member is fixed to the end of the transmission shaft 75 and extends from the end in a direction different from the lever 78. The coil spring 87 is spanned between the member and the other end portion 81B of the arm 81. The transmission shaft 75 is urged into rotation clockwise in FIG. 5B by the coil spring 87. When the transmission shaft 75 is rotated clockwise by the urging, the lever 78 on the transmission shaft 75 abuts against the pin 83 on the other end portion 81B of the arm 81 and is thus positioned in this position.

In the above manner, the bottom edge of the recess 85 in the arm 81 abuts against the transmission shaft 75 to position the arm 81 and the lever 78 on the transmission shaft 75 abuts against the pin 83 on the other end portion 81B of the arm 81 and is thus positioned. Thus, the rotational position of the gear 77 on the transmission shaft 75 is fixed, the rotational position of the gear 76 on the shaft 27A of the pressing member 27 meshing with the gear 77 is fixed, and the pressing member 27 is positioned in a second ready-to-pivot position P2.

The sector gear 64 corresponds to the rotary member. The projection 641 of the sector gear 64 corresponds to the first power transmission mechanism. The pin 82 projecting from the side surface of the sector gear 64, the arm 81, the lever 78, and the gears 77 and 76 correspond to the second power transmission mechanism. The loading assist mechanism 500 includes the flapping member 26, the pressing member 27, the pin 82, the arm 81, the lever 78, the gears 77 and 76, the drive motor 52, the sector gear 64 including the projection 641, and so on.

<First Actions of Flapping Member 26 and Pressing Member 27>

As described above, the drive control device 55 (see FIG. 3) rotates the drive motor 52 in the forward or reverse direction to rotate the sector gear 64 (for example, rotate counterclockwise or clockwise in FIG. 5B). With the timing of the position sensor 53 detecting the end 64A of the sector gear 64, the drive control device 55 stops the drive motor 52. Thus, the sector gear 64 is positioned in the initial rotational position PS and the flapping member 26 returns to the first ready-to-pivot position P1.

At this time, the bottom edge of the recess 85 in the arm 81 abuts against the transmission shaft 75 and, thus, the arm 81 is positioned in this position. Furthermore, the lever 78 on the transmission shaft 75 abuts against the pin 83 on the other end portion 81B of the arm 81 and is thus positioned in this position. Thus, the rotational positions of the gears 77 and 76 are set and the pressing member 27 is positioned in the second ready-to-pivot position P2.

In this manner, as shown in FIGS. 4A, 4B, 5A, and 5B, the sector gear 64 is positioned in the initial rotational position PS, the flapping member 26 is positioned in the first ready-to-pivot position P1, and the pressing member 27 is positioned in the second ready-to-pivot position P2.

The drive control device 55 controls the conveyance drive device 51 to move the upper ejection roller 23A upward and thus locate the upper and lower ejection rollers 23A, 23B away from each other. In this state, the drive control device 55 allows the conveyance roller pair 21 and the intermediate sheet discharge roller pair 22 to convey toward the processing tray 25 a recording paper sheet P having been conveyed from the image forming apparatus 10.

Thus, in a state where, as shown in FIG. 2, the upper ejection roller 23A is moved upward and kept away from the lower ejection roller 23B, the recording paper sheet P is conveyed past between the intermediate sheet discharge roller pair 22 and along the underside of the flapping member 26. The leading end of the recording paper sheet P reaches between the pair of ejection rollers 23A, 23B and the trailing end of the recording paper sheet P moves above the processing tray 25.

<Second Actions of Flapping Member 26 and Pressing Member 27>

Figure 6A:
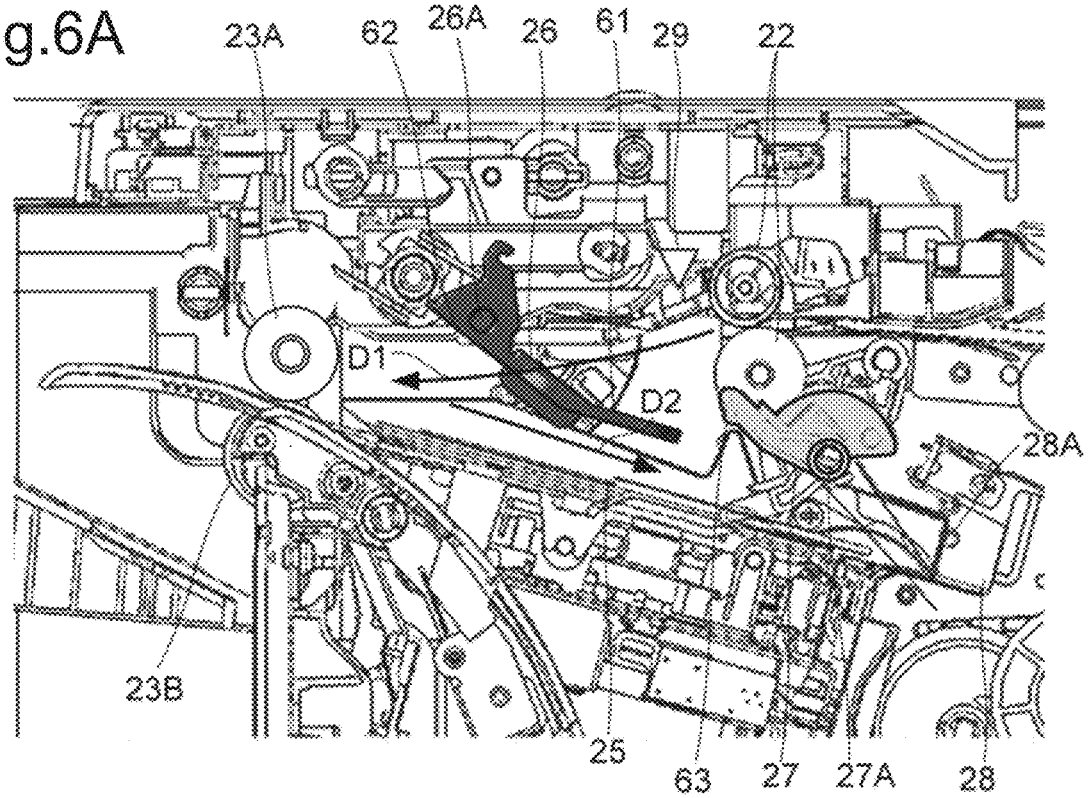
FIG. 6A is a cross-sectional view showing the structures of and around the flapping member and the pressing member.
Figure 6B:
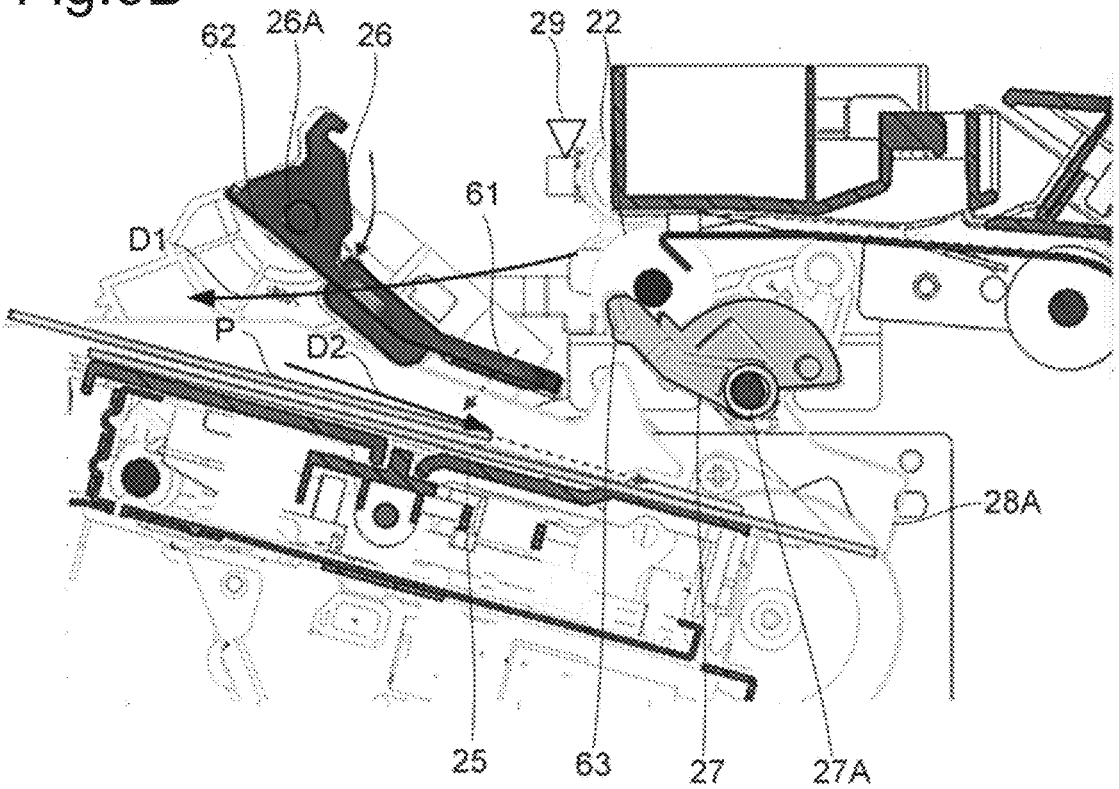
FIG. 6B is a cross-sectional view showing the structures of and around the flapping member and the pressing member in magnification and shows a state where the flapping member is pivoted and the pressing member is in a ready-to-pivot position.
Figure 7A:
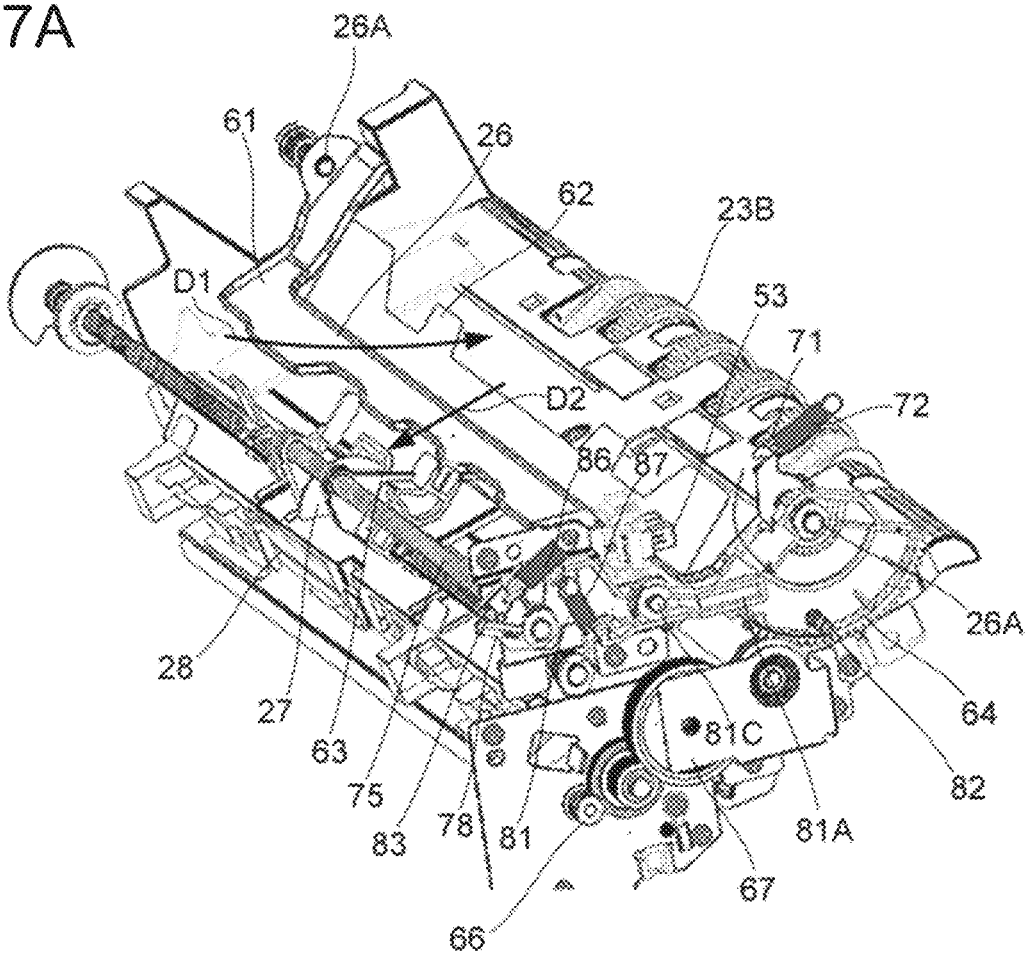
FIG. 7A is a perspective view showing the structures of and around the flapping member and the pressing member when viewed from obliquely above.
Figure 7B:
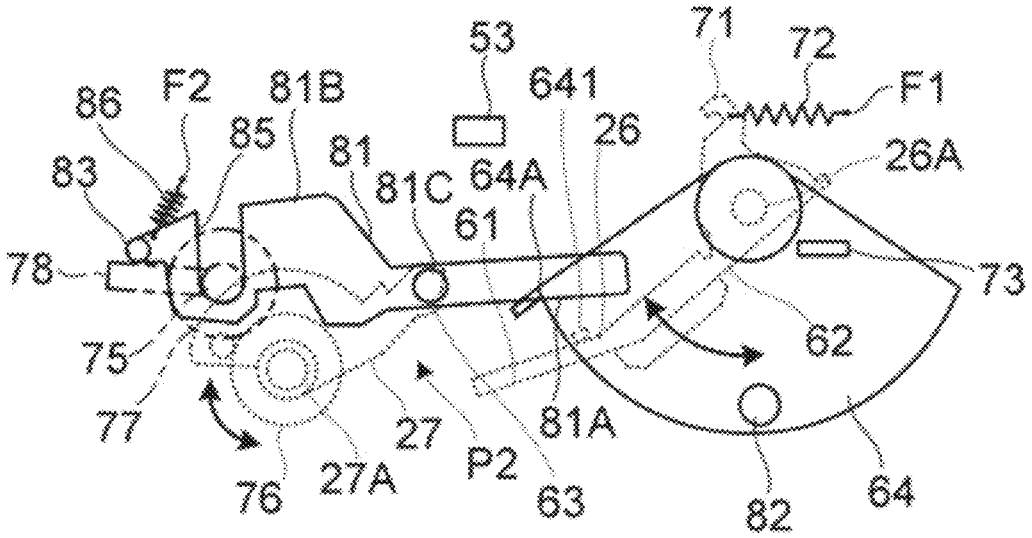
FIG. 7B is a side view schematically showing the mechanism for pivoting the flapping member and the pressing member.

FIG. 6A is a cross-sectional view showing the structures of and around the flapping member 26 and the pressing member 27. FIG. 6B is a cross-sectional view showing the structures of and around the flapping member 26 and the pressing member 27 in magnification. FIG. 6B shows a state where the flapping member 26 pivots and the pressing member 27 is in a ready-to-pivot position. FIG. 7A is a perspective view showing the structures of and around the flapping member 26 and the pressing member 27 when viewed from obliquely above. FIG. 7B is a side view schematically showing the mechanism for pivoting the flapping member 26 and the pressing member 27. FIG. 7B shows a state where the flapping member 26 pivots and the pressing member 27 is in a ready-to-pivot position.

FIGS. 6A and 6B are views showing the sheet post-processing device 20 when viewed from the front side thereof. FIGS. 7A and 7B are views showing the sheet post-processing device 20 when viewed from the back side thereof.

For clarity, FIGS. 7A and 7B omit the conveyance roller pair 21, the intermediate sheet discharge roller pair 22, and the upper ejection roller 23A.

When, during conveyance of a recording paper sheet P, the sheet discharge sensor 26 detects the trailing end of the recording paper sheet P, i.e., when the trailing end of the recording paper sheet P moves away from the nip between the intermediate sheet discharge roller pair 22 and passes above the sheet discharge sensor 29, the drive control device 55 controls, with this timing, the conveyance drive device 51 to move the upper ejection roller 23 A downward and bring it close to the lower ejection roller 23B. Thus, the leading end of the recording paper sheet P is held between the pair of ejection rollers 23A, 23B and the trailing end of the recording paper sheet P stops approximately below the sheet discharge sensor 29.

The drive control device 55 rotates the drive motor 52 in the forward direction to rotate the sector gear 64 counterclockwise in FIG. 5B from the initial rotational position PS and thus pivot the flapping member 26 counterclockwise in FIG. 5B.

Thus, in a state where the leading end of the recording paper sheet P is held between the pair of ejection rollers 23A, 23B, the flapping member 26 pivots counterclockwise from the first ready-to-pivot position P1 shown in FIG. 5B and changes to a position shown in FIGS. 6A and 6B. During this pivoting, the trailing end of the recording paper sheet P is pushed onto the processing tray 25 from above by the flapping portion 61 (particularly, its distal end portion 611) of the flapping member 26.

The drive control device 55 controls the conveyance drive device 51 to rotate the ejection rollers 23A, 23B certain angles of rotation in opposite directions to those during sheet ejection to the ejection tray 24. Thus, the recording paper sheet P is moved on the processing tray 25 toward the stapling device 28 by the ejection rollers 23A, 23B. During the movement of the recording paper sheet P toward the stapling device 28, as shown in FIGS. 6A and 6B, the flapping portion 61 of the flapping member 26 occupies a position a distance from the processing tray 25 and closer to the loading surface of the processing tray 25 than the first ready-to-pivot position P1. Therefore, upward warpage or the like of the trailing end of the recording paper sheet P can be prevented. In addition, the trailing end of the recording paper sheet P can smoothly enter within the sheet receiving portion 280 and quickly abut against the reference surface 28A of the stapling device 28.

<Third Actions of Flapping Member 26 and Pressing Member 27>

Figure 8A:
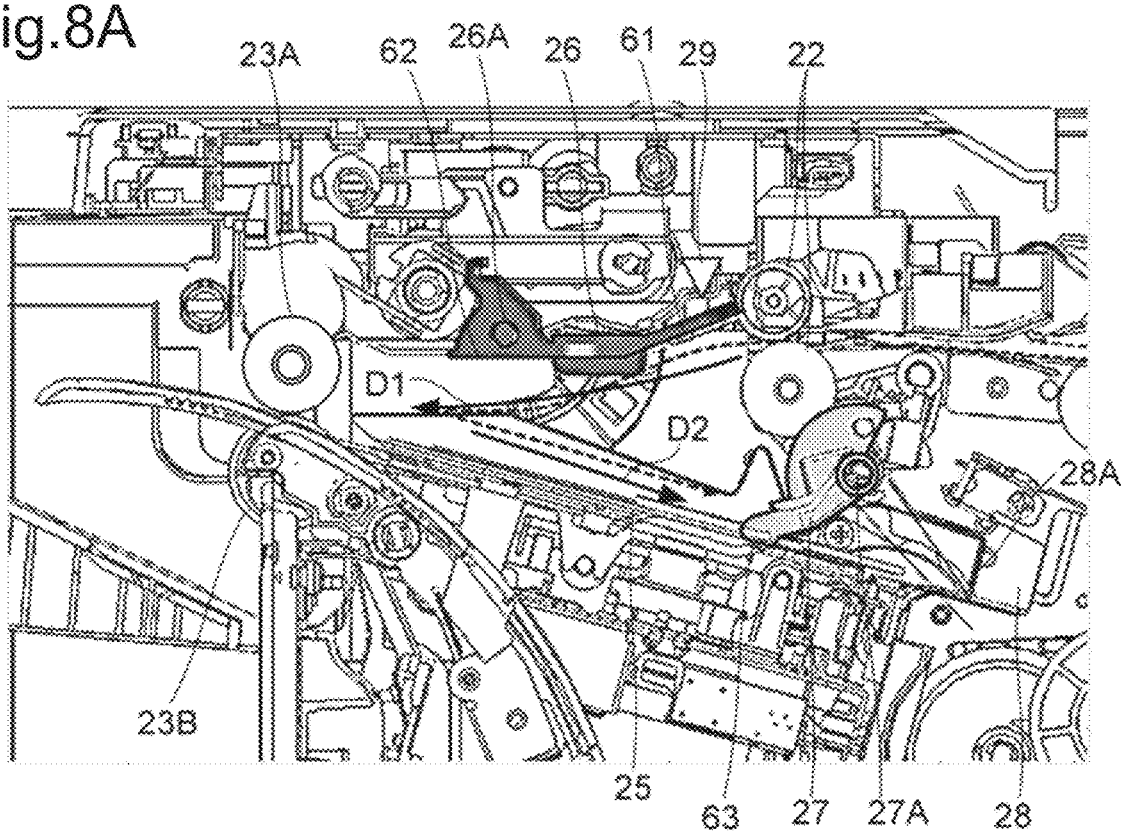
FIG. 8A is a cross-sectional view showing the structures of and around the flapping member and the pressing member.
Figure 8B:
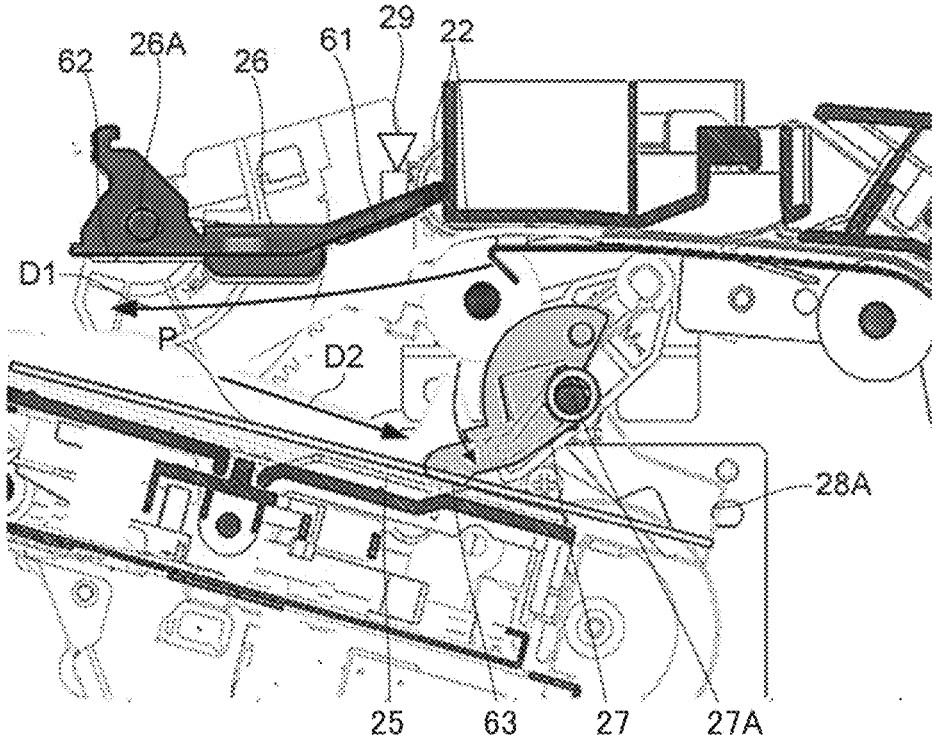
FIG. 8B is a cross-sectional view showing the structures of and around the flapping member and the pressing member in magnification.
Figure 9A:
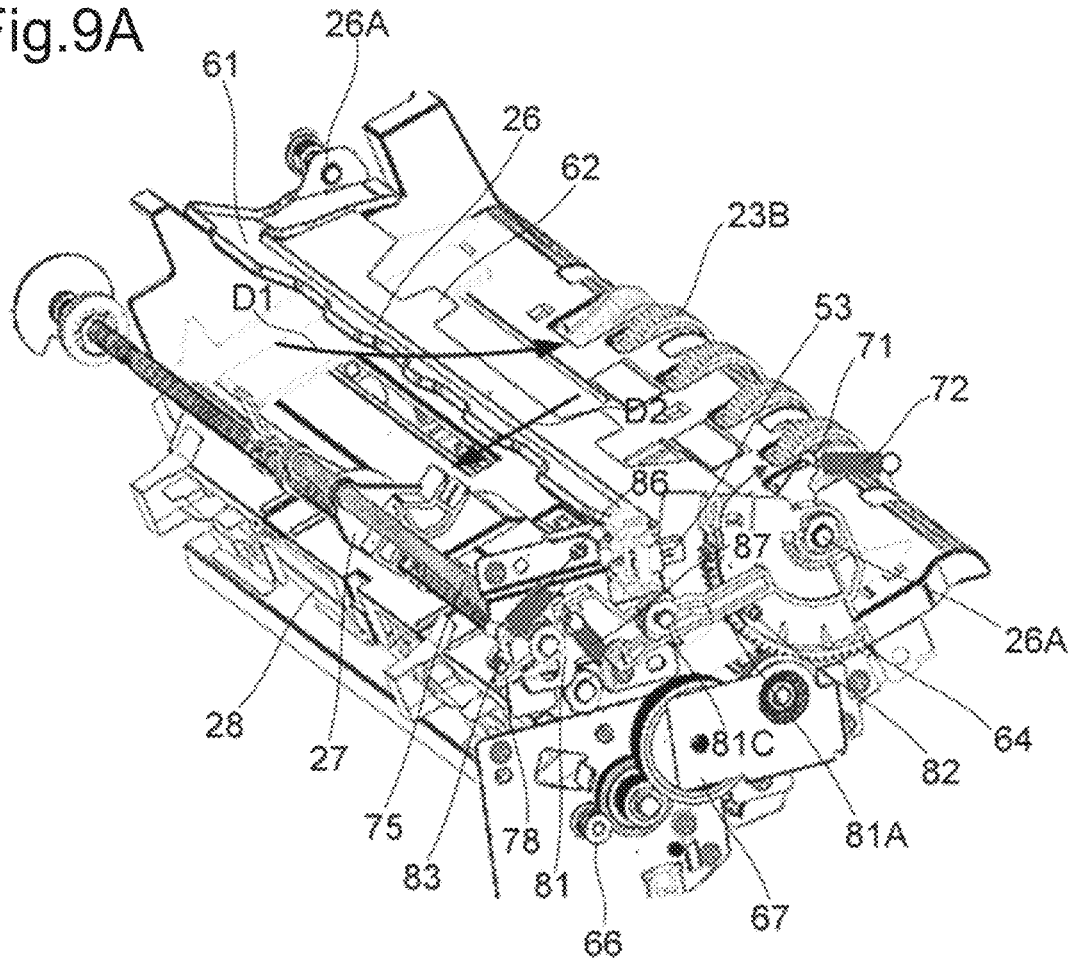
FIG. 9A is a perspective view showing the structures of and around the flapping member and the pressing member when viewed from obliquely above.
Figure 9B:
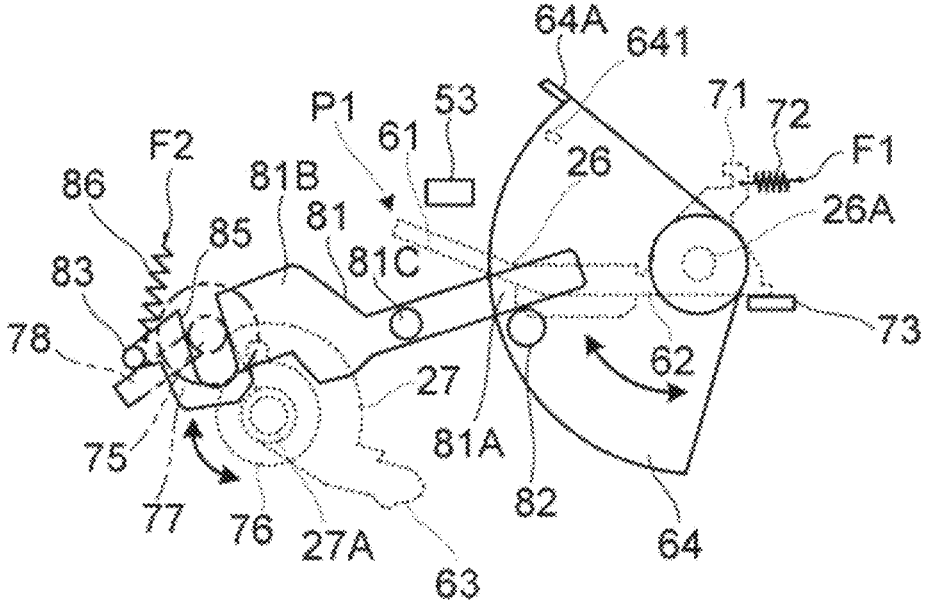
FIG. 9B is a side view schematically showing the mechanism for pivoting the flapping member and the pressing member.

FIG. 8A is a cross-sectional view showing the structures of and around the flapping member 26 and the pressing member 27. FIG. 8B is a cross-sectional view showing the structures of and around the flapping member 26 and the pressing member 27 in magnification. FIG. 8B shows a state where the flapping member 26 is in a ready-to-pivot position and the pressing member 27 has pivoted. FIG. 9A is a perspective view showing the structures of and around the flapping member 26 and the pressing member 27 when viewed from obliquely above. FIG. 9B is a side view schematically showing the mechanism for pivoting the flapping member 26 and the pressing member 27. FIG. 9B shows a state where the flapping member 26 is in a ready-to-pivot position and the pressing member 27 has pivoted.

FIGS. 8A and 8B are views showing the sheet post-processing device 20 when viewed from the front side thereof. FIGS. 9A and 9B are views showing the sheet post-processing device 20 when viewed from the back side thereof.

For clarity, FIGS. 9A and 9B omit the conveyance roller pair 21, the intermediate sheet discharge roller pair 22, and the upper ejection roller 23A.

After the second actions described above, the drive control device 55 rotates the drive motor 52 in the reverse direction opposite to the forward direction to rotate the sector gear 64 clockwise in FIG. 7B. During the time, the flapping member 26 is pivoted clockwise in FIG. 7B by the urging force of the coil spring 72. When the position sensor 53 detects the end 64A of the sector gear 64, the drive control device 55 determines that the sector gear 64 has reached the initial rotational position PS. As shown in FIG. 5B, as a result of pivoting of the flapping member 26, the guide portion 62 abuts against the stopper 73 and, thus, the flapping member 26 returns to the first ready-to-pivot position P1.

Though the sector gear 64 has reached the initial rotational position PS, the drive control device 55 keeps rotating the drive motor 52 in the reverse direction, without stopping it, to further rotate the sector gear 64 clockwise in FIG. 5B. Thus, as shown in FIG. 9B, the pin 82 on the sector gear 64 abuts against the one end portion 81A of the arm 81 to push the one end portion 81A of the arm 81 upward.

During the time, as shown in FIGS. 9A and 9B, the arm 81 pivots counterclockwise about the shaft 81C and, thus, the pin 83 on the other end portion 81B of the arm 81 pushes the lever 78 on the transmission shaft 75 downward. Thus, the transmission shaft 75 rotates counterclockwise in FIG. 9B and the gear 76 on the shaft 27A of the pressing member 27 meshing with the gear 77 on the transmission shaft 75 rotates clockwise in FIG. 9B. As a result, the pressing member 27 pivots clockwise in FIG. 9B from the second ready-to-pivot position P2 and, as shown in FIGS. 8A, 8B, 9A, and 9B, the pressing end portion 63 of the pressing member 27 presses the trailing end of the recording paper sheet P onto the processing tray 25.

<Fourth Actions of Flapping Member 26 and Pressing Member 27>

Figure 10A:
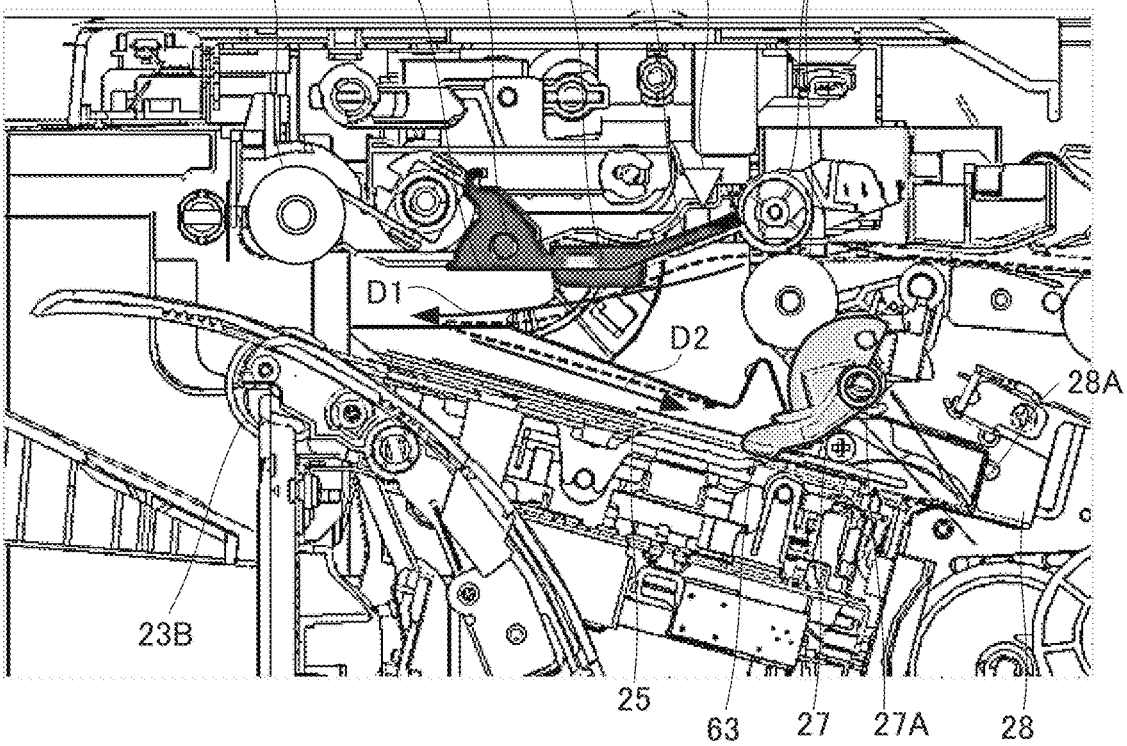
FIG. 10A is a perspective view showing the structures of and around the flapping member and the pressing member when viewed from obliquely above.
Figure 10B:
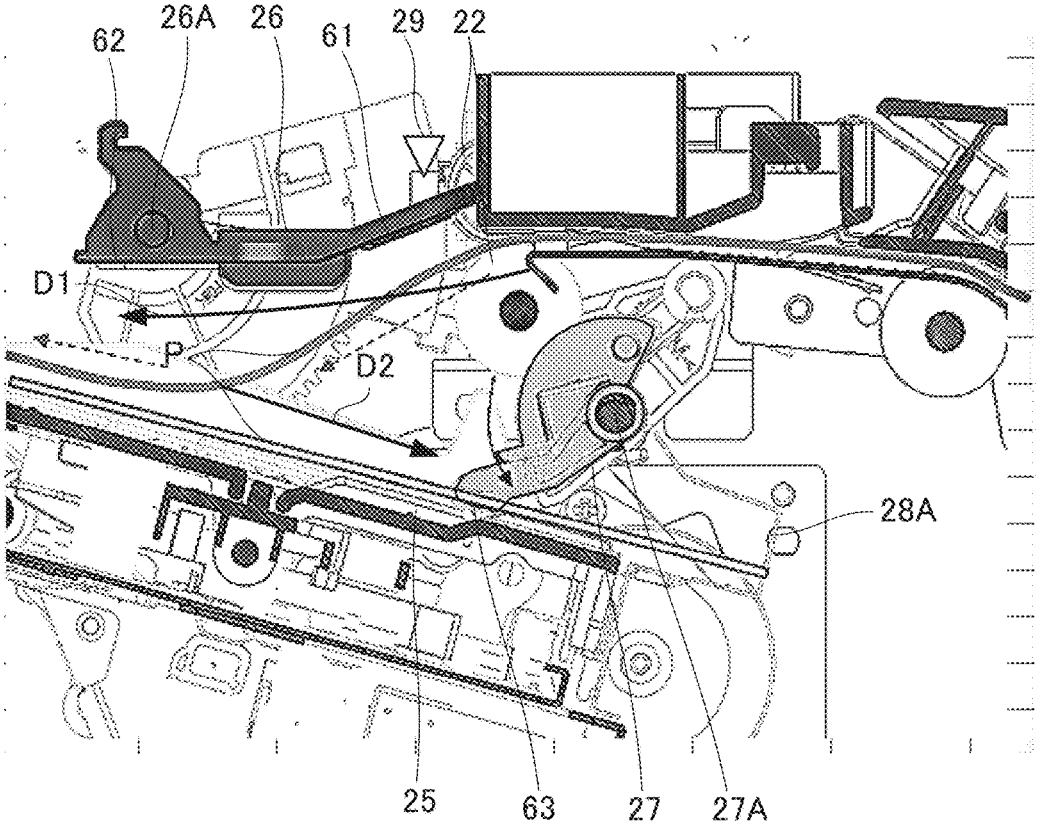
FIG. 10B is a side view schematically showing the mechanism for pivoting the flapping member and the pressing member.

FIG. 10A is a cross-sectional view showing the structures of and around the flapping member 26 and the pressing member 27. FIG. 10B is a cross-sectional view showing the structures of and around the flapping member 26 and the pressing member 27 in magnification. FIG. 10B shows a state when the pressing member 27 has pivoted and a next recording paper sheet P is being conveyed.

As shown in FIGS. 10A and 10B, the drive control device 55 keeps a state where the pressing end portion 63 of the pressing member 27 presses the trailing end of the recording paper sheet P onto the processing tray 25.

After the third actions described above, the drive control device 55 controls the conveyance drive device 51 to move the upper ejection roller 23A upward and thus locate the upper and lower ejection rollers 23A, 23B away from each other. In this state, a next recording paper sheet P is conveyed from the image forming apparatus 10 toward the processing tray 25 by the conveyance roller pair 21 and the intermediate sheet discharge roller pair 22.

At this time, as shown in FIGS. 10A and 10B, the pressing end portion 63 of the pressing member 27 keeps pressing the trailing end of the previous recording paper sheet P onto the processing tray 25. Therefore, even if a friction occurs between the previous recording paper sheet P and the next recording paper sheet P when the next recording paper sheet P lies over the previous recording paper sheet P already loaded on the processing tray 25 while moving in the direction of sheet conveyance, the previous recording paper sheet P on the processing tray 25 is prevented from being dragged away in the direction of sheet conveyance by the next recording paper sheet P. Therefore, the previous recording paper sheet P on the processing tray 25 can be prevented from being displaced.

<Fifth Actions of Flapping Member 26 and Pressing Member 27>

When, after the fourth actions, the sheet discharge sensor 29 detects the trailing end of the next recording paper sheet P, the drive control device 55 controls, with this timing, the conveyance drive device 51 to move the upper ejection roller 23A downward and thus bring the upper and lower ejection rollers 23A, 23B close to each other. Thus, the leading end of the next recording paper sheet P is held between the pair of ejection rollers 23A, 23B and the trailing end of the next recording paper sheet P stops approximately below the sheet discharge sensor 29.

The drive control device 55 rotates the drive motor 52 in the forward direction to rotate the sector gear 64 counterclockwise in FIG. 5B. At the timing when the position sensor 53 has detected the end 64A of the sector gear 64, the drive control device 55 determines that the sector gear 64 has reached the initial rotational position PS.

At this time, the arm 81 is pivoted clockwise in FIG. 5B by the urging of the coil spring 86. Thus, the bottom edge of the recess 85 in the arm 81 abuts against the transmission shaft 75 and, thus, the arm 81 is positioned in this position. Furthermore, the transmission shaft 75 is rotated clockwise in FIG. 5B by the urging of the coil spring 87 (see FIG. 5A) and, thus, the lever 78 on the transmission shaft 75 abuts against the pin 83 on the other end portion 81B of the arm 81 and is positioned in this position. As a result, the rotational positions of the gear 77 on the transmission shaft 75 and the gear 76 on the shaft 27A of the pressing member 27 are set and the pressing member 27 returns to the second ready-to-pivot position P2 (see FIG. 5B).

Though the sector gear 64 has reached the initial rotational position PS, the drive control device 55 keeps rotating the drive motor 52 in the forward direction, without stopping it, to further rotate the sector gear 64 counterclockwise in FIG. 7B. As a result, as shown in FIG. 7B, the flapping member 26 pivots counterclockwise.

Thus, as shown in FIGS. 6A and 6B, in a state where the leading end of the next recording paper sheet P is held between the pair of ejection rollers 23A, 23B, the flapping member 26 pivots from the first ready-to-pivot position P1 to the position shown in FIG. 6A. Thus, the flapping portion 61 of the flapping member 26 suppresses the warpage or the like of the trailing end of the next recording paper sheet P and pushes the trailing end of the next recording paper sheet P onto the processing tray 25.

The drive control device 55 controls the conveyance drive device 51 to rotate the ejection rollers 23A, 23B certain angles of rotation in opposite directions to those during sheet ejection to the ejection tray 24. Thus, the ejection rollers 23A, 23B move the next recording paper sheet P on the processing tray 25 toward the stapling device 28. As a result, the trailing end of the next recording paper sheet P abuts against the reference surface 28A of the stapling device 28.

Afterward, the above-described <Third Actions of Flapping Member 26 and Pressing Member 27>, <Fourth Actions of Flapping Member 26 and Pressing Member 27>, and <Fifth Actions of Flapping Member 26 and Pressing Member 27> are repeated. Thus, a plurality of recording paper sheets P are loaded and aligned on the processing tray 25.

When the conveyance of all of a scheduled number of recording paper sheets P is completed and there is no next recording paper sheet P to be conveyed, subsequently to the completion of the <Fifth Actions of Flapping Member 26 and Pressing Member 27>, the drive control device 55 allows the stapling device 28 to staple the trailing end of the bundle of recording paper sheets P. Furthermore, the drive control device 55 controls the conveyance drive device 51 to move the upper ejection roller 23A away from the lower ejection roller 23B. Subsequently, the drive control device 55 allows the recording paper sheet conveyance roller to move the bundle of recording paper sheets P on the processing tray 25 toward the ejection rollers 23A, 23B.

The drive control device 55 controls the conveyance drive device 51 to bring the upper ejection roller 23A close to the lower ejection roller 23B and press the upper ejection roller 23A toward the lower ejection roller 23B to allow the leading end of the bundle of recording paper sheets P to be held between the pair of ejection rollers 23A, 23B. The drive control device 55 rotates the ejection rollers 23A, 23B in their forward directions to allow the pair of ejection rollers 23A, 23B to eject the bundle of recording paper sheets P from the processing tray 25 to the ejection tray 24.

In the general image processing device and sheet loading device described previously, each time a sheet is conveyed down onto the tray, the flapping roller is moved down and allowed to convey the sheet reversely and, thus, the trailing end of the sheet is allowed to abut against the trailing end reference fence to align the sheet with the other sheets. When in these devices a next sheet is conveyed down onto the tray, a phenomenon may occur where the next sheet lies over and drags the previous sheet on the tray and the previous sheet is thus displaced.

In order to prevent the occurrence of the above phenomenon, it is conceivable to additionally provide a pressing member that holds down the previous sheet on the tray. However, in order to load a plurality of sheets on the tray, it is necessary to move the pressing member back away from the tray at an appropriate timing. If for this purpose a motor or the like is further provided as a drive source for the pressing member, this leads to increases in size, complexity, and cost of the device.

Unlike the above general devices, in the sheet post-processing device 20 according to this embodiment, the flapping member 26 and the pressing member 27 are pivoted by a single drive motor 52. Therefore, increases in size, complexity, and cost of the device can be prevented.

Furthermore, with the timing of the position sensor 53 detecting the end 64A of the sector gear 64, the drive control device 55 determines the initial rotational position PS of the sector gear 64, rotates the drive motor 52 in the forward direction to control the number of revolutions of the drive motor 52, and controls the angles α of rotation and pivoting of the sector gear 64 and the flapping member 26 counterclockwise in FIG. 5B, the angles α of rotation and pivoting being necessary for movement of the flapping member 26 from the first ready-to-pivot position P1 shown in FIG. 5B to the position shown in FIG. 7B.

Moreover, with the timing of the position sensor 53 detecting the end 64A of the sector gear 64, the drive control device 55 determines the initial rotational position PS of the sector gear 64, rotates the drive motor 52 in the reverse direction to control the number of revolutions of the drive motor 52, and rotates the sector gear 64 a certain angle of rotation clockwise in FIG. 5B from the initial rotational position PS shown in FIG. 5B to allow the pin 82 on the sector gear 64 to abut against the one end portion 81A of the arm 81. Subsequently, the drive control device 55 rotates the drive motor 52 in the reverse direction to control the number of revolutions of the drive motor 52 and controls the angle of further rotation of the sector gear 64 clockwise in FIG. 5B. Thus, as shown in FIG. 9B, the pin 82 on the sector gear 64 pushes the one end portion 81A of the arm 81 upward and the pin 83 on the other end portion 81B of the arm 81 pushes the lever 78 on the transmission shaft 75 downward, resulting in rotation of the gear 77 on the transmission shaft 75 and the gear 76 on the shaft 27A of the pressing member 27. In this manner, the drive control device 55 controls the angle β of pivoting of the pressing member 27 counterclockwise in FIG. 9B to pivot the pressing member 27 from the second ready-to-pivot position P2 to the position shown in FIG. 9B.

For example, with increasing number of recording paper sheets loaded on the processing tray 25, the thickness of the bundle of recording paper sheets also increases. Therefore, as for the next recording paper sheet P to be conveyed from the image forming apparatus 10, even when the angle α of pivoting of the flapping member 26 is somewhat decreased, the trailing end of the next recording paper sheet P can be pushed down onto the uppermost layer of the bundle of recording paper sheets on the processing tray 25 by the flapping portion 61 of the flapping member 26.

Therefore, each time the sheet discharge sensor 29 detects the trailing end of a recording paper sheet P, the drive control device 55 counts the number of recording paper sheets that will be loaded on the processing tray 25, for example, based on a number-of-sheets count signal sent from the control device 46. The drive control device 55 controls the drive motor 55 to decrease the angle of rotation of the sector gear 64 counterclockwise in FIG. 5B from the initial rotational position PS as the counted number of sheets increases, thus decreasing the angle α of pivoting of the flapping member 26 counterclockwise in FIG. 5B from the first ready-to-pivot position P1. Thus, the trailing end of the recording paper sheet P can be prevented from being excessively pushed downward by the flapping portion 61 of the flapping member 26.

As described above, with increasing number of recording paper sheets P loaded on the processing tray 25, the thickness of the bundle of recording paper sheets P also increases. Therefore, the preferred configuration is to decrease the angle β of pivoting of the pressing member 27 with increasing number of recording paper sheets P on the processing tray 25, thus weakening the pressure of the pressing end portion 83 of the pressing member 27 against the trailing end of the recording paper sheet P.

Each time the sheet discharge sensor 29 detects the trailing end of a recording paper sheet P, the drive control device 55 counts the number of recording paper sheets that will be loaded on the processing tray 25. The drive control device 55 controls the drive motor 52 to decrease the angle of rotation of the sector gear 64 clockwise from the initial rotational position PS as the counted number of sheets increases, thus decreasing the angle β of pivoting of the pressing end portion 63 clockwise from the second ready-to-pivot position P2. Thus, the trailing end of the recording paper sheet P can be prevented from being strongly pressed and thus damaged.

The image forming apparatus 10 forms an image of an original document on a recording paper sheet P using an ink-jet system. Therefore, with increasing amount of ink discharged from each line head 15 to the recording paper sheet P, the amount of ink adhering to the recording paper sheet P also increases to increase the thickness of the recording paper sheet P. Furthermore, the thickness of the recording paper sheet P increases or decreases depending on the type of recording paper sheet P.

Therefore, a factor may be set according to not only the number of recording paper sheets P, but also the amount of ink discharged to the recording paper sheet P or the type of recording paper sheet P (when the thickness thereof increases) and the factor may be used to increase the counted number of recording paper sheets P for use in determining the angle of rotation of the sector gear 64.

For example, a plurality of first factors according to different types of recording paper sheet P are set and previously stored in the storage device 54. Furthermore, a plurality of second factors according to different amounts of ink discharged to the recording paper sheet P are set and previously stored in the storage device 54.

The control device 46 of the image forming apparatus 10 acquires the type of recording paper sheet P input by a touch gesture on the GUI displayed on the screen of the display device 41. The control device 46 acquires, for each recording paper sheet P, the amount of ink discharged to the recording paper sheet P from each line head 15. The control device 46 outputs a control signal indicating the type of recording paper sheet P and the amount of ink discharged to the recording paper sheet P through the interface 47 to the drive control device 55 of the sheet post-processing device 20.

Each time a recording paper sheet P is conveyed from the image forming apparatus 10, the drive control device 55 of the sheet post-processing device 20 receives the control signal indicating the type of recording paper sheet P and the amount of ink discharged to the recording paper sheet P through the interface 56 from the control device 46. The drive control device 55 determines the type of recording paper sheet P and the amount of ink discharged indicated by the control signal, reads the first factor associated with the type of recording paper sheet P from the storage device 54, and reads the second factor associated with the amount of ink discharged to the recording paper sheet P from the storage device 54. The drive control device 55 corrects the number of recording paper sheets P counted in the above manner to an increased number, by multiplying the number of recording paper sheets P by the first and second factors.

The drive control device 55 controls the drive motor 52 to decrease the angle of rotation of the sector gear 64 counterclockwise in FIG. 5B from the initial rotational position PS as the corrected number of recording paper sheets P increases, thus decreasing the angle α of pivoting of the flapping member 26 counterclockwise in FIG. 5B from the first ready-to-pivot position P1. Thus, the trailing end of the recording paper sheet P can be prevented from being excessively pushed downward by the flapping portion 61 of the flapping member 26.

The drive control device 55 controls the drive motor 52 to decrease the angle of rotation of the sector gear 64 clockwise in FIG. 5B from the initial rotational position PS as the corrected number of recording paper sheets P increases, thus decreasing the angle β of pivoting of the pressing end portion 63 clockwise in FIG. 5B from the second ready-to-pivot position P2. Thus, the trailing end of the recording paper sheet P can be prevented from being strongly pressed and thus damaged.

Figure 11:
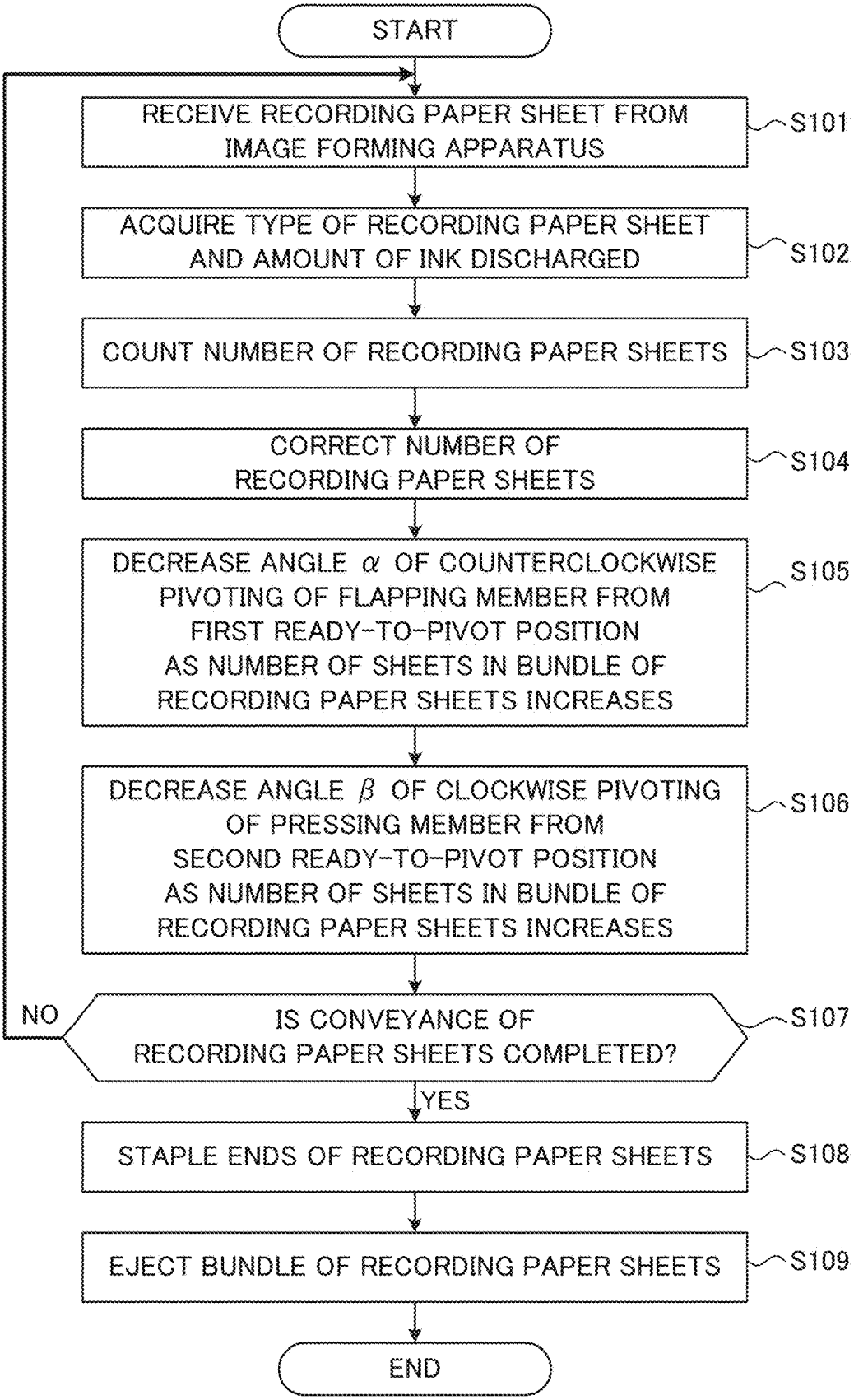
FIG. 11 is a flowchart showing the control procedure of angle-of-pivoting adjustment processing.

FIG. 11 is a flowchart showing the control procedure of angle-of-pivoting adjustment processing for adjusting, at every conveyance of a recording paper sheet P to the sheet post-processing device 20, the angle α of pivoting of the flapping member 26 and the angle β of pivoting of the pressing end portion 63 according to the type of recording paper sheet P and the amount of ink discharged to the recording paper sheet P, stapling a bundle of recording paper sheets P on the processing tray 25, and ejecting the bundle of recording paper sheets P.

For each recording paper sheet P, the control device 46 of the image forming apparatus 10 calculates the coverage rate of the recording paper sheet P and outputs a control signal indicating the type of recording paper sheet P and the amount of ink discharged to the recording paper sheet P through the interface 47 to the drive control device 55 of the sheet post-processing device 20.

Each time a recording paper sheet P is conveyed from the image forming apparatus 10 (step S101), the drive control device 55 of the sheet post-processing device 20 receives the control signal indicating the type of recording paper sheet P and the amount of ink discharged to the recording paper sheet P through the interface 56 (step S102). The drive control device 55 reads the first factor associated with the type of recording paper sheet P from the storage device 54, reads the second factor associated with the amount of ink discharged to the recording paper sheet P from the storage device 54, and counts the number of sheets in a bundle of recording paper sheets P (a set of recording paper sheets P) in the manner described previously (step S103). The drive control device 55 corrects the counted number of recording paper sheets P to an increased number by multiplying the number of recording paper sheets P by the first and second factors (step S104).

The drive control device 55 controls the drive motor 52 to decrease the angle of counterclockwise rotation of the sector gear 64 from the initial rotational position PS shown in FIG. 5B as the corrected number of recording paper sheets P increases, thus decreasing the angle α of counterclockwise pivoting of the flapping member 26 from the first ready-to-pivot position P1 (step S105).

The drive control device 55 controls the drive motor 52 to decrease the angle of clockwise rotation of the sector gear 64 from the initial rotational position PS shown in FIG. 5B as the corrected number of recording paper sheets P increases, thus decreasing the angle β of clockwise pivoting of the pressing end portion 63 from the second ready-to-pivot position P2 (step S106).

When the conveyance of all the scheduled number of recording paper sheets P is completed, the control device 46 of the image forming apparatus 10 outputs a control signal indicating the completion of the conveyance through the interface 47 to the drive control device 55 of the sheet post-processing device 20.

Unless receiving the control signal indicating the completion of the conveyance through the interface 56 ("No" in step S107), the drive control device 55 of the sheet post-processing device 20 repeats the processing from step S101 to step S106.

When receiving the control signal indicating the completion of the conveyance through the interface 56 ("Yes" in step S107), the drive control device 55 of the sheet post-processing device 20 allows the stapling device 28 to staple the trailing ends of the plurality of recording paper sheets P together (step S108). The drive control device 55 controls the conveyance drive device 51 to allow the pair of ejection rollers 23A, 23B to eject the bundle of recording paper sheets P from the processing tray 25 to the ejection tray 24 (step S109).

Although in the above embodiment the sheet post-processing device 20 is provided with the drive control device 55, the present disclosure is not limited to this embodiment. For example, the drive control device 55 may be dispensed with and the control device 46 may directly control the sheet post-processing device 20.

Although in the above embodiment an image forming apparatus of an ink-jet system is taken as an example of the image forming apparatus 10, the present disclosure is not limited to this embodiment. The present disclosure is also applicable to an image forming apparatus of an electrophotographic system.

The structures, configurations, and processing of the embodiment described with reference to FIGS. 1 to 11 are merely illustrative and are not intended to limit the present disclosure to them.

While the present disclosure has been described in detail with reference to the embodiments thereof, it would be apparent to those skilled in the art the various changes and modifications may be made therein within the scope defined by the appended claims.

What is claimed is:

1. A sheet post-processing device comprising:

a tray;

a sheet discharge roller pair that discharges a sheet onto the tray;

a conveyance mechanism that conveys the sheet on the tray in a direction opposite to a direction of sheet discharge of the sheet discharge roller pair to allow a trailing end of the sheet in the direction of sheet discharge to abut against an end of the tray;

a loading assist mechanism that handles the sheet on the tray;

a post-processing device that subjects the sheet on the tray to post-processing; and a control device including a processor, and configured to control action of the loading assist mechanism, when the processor executes a control program, the loading assist mechanism comprising:

a flapping member that is provided above the tray and performs a flapping action of, when the trailing end of the sheet in the direction of sheet discharge moves away from the sheet discharge roller pair and reaches above the tray, flapping the trailing end of the sheet downward to drop the sheet on the tray;

a pressing member that performs a pressing action of pressing the sheet dropped by the flapping member onto the tray with the trailing end of the sheet abutting against the end of the tray;

a first power transmission mechanism that pivots the flapping member from a predetermined first ready-to-pivot position to allow the flapping member to perform the flapping action;

a second power transmission mechanism that pivots the pressing member from a predetermined second ready-to-pivot position to allow the pressing member to perform the pressing action;

a rotary member that is rotatable in a first direction and a second direction opposite to the first direction, transmits, during rotation in the first direction, power for pivoting the flapping member to the first power transmission mechanism, and transmits, during rotation in the second direction, power for pivoting the pressing member to the second power transmission mechanism; and a drive source that rotates the rotary member, wherein the control device controls the drive source to control an angle of rotation of the rotary member in the first direction and thus control an angle of pivoting of the flapping member from the first ready-to-pivot position, and controls the drive source to control an angle of rotation of the rotary member in the second direction and thus control an angle of pivoting of the pressing member from the second ready-to-pivot position.

2. The sheet post-processing device according to claim 1, further comprising a position detecting device that detects an initial rotational position of the rotary member, wherein when the flapping member is located in the first ready-to-pivot position and the pressing member is located in the second ready-to-pivot position, the rotary member is positioned in the initial rotational position, and the control device controls the drive source to control the angle of rotation of the rotary member in the first direction from a state where the position detecting device detects the initial rotational position of the rotary member or the angle of rotation of the rotary member in the second direction from the state where the position detecting device detects the initial rotational position of the rotary member.

3. The sheet post-processing device according to claim 2, wherein the control device counts a number of sheets loaded on the tray and controls the drive source based on the counted number of sheets to control, according to the counted number of sheets, the angle of rotation of the rotary member in the first direction from the state where the position detecting sensor detects the initial rotational position of the rotary member or the angle of rotation of the rotary member in the second direction from the state where the position detecting sensor detects the initial rotational position of the rotary member.

4. The sheet post-processing device according to claim 3, wherein the control device corrects the counted number of sheets to an increased number by multiplying the counted number of sheets by a predetermined first factor associated with a type of the sheet and a predetermined second factor associated with an amount of ink discharged to the sheet.

5. A sheet post-processing system comprising:

an image forming apparatus comprising an image forming device that forms an image of an original document on a sheet; and the sheet post-processing device according to claim 1, wherein the sheet post-processing device further comprises a conveyance roller pair that receives the sheet with the image formed thereon from the image forming apparatus and conveys the sheet toward the tray.

* * * * *